US010449604B2

(12) United States Patent
Yokoyama

(10) Patent No.: US 10,449,604 B2
(45) Date of Patent: Oct. 22, 2019

(54) INJECTION APPARATUS AND MOLDING MACHINE

(71) Applicant: Toshiba Kikai Kabushiki Kaisha, Chiyoda-ku, Tokyo (JP)

(72) Inventor: Hiroshi Yokoyama, Zama (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/945,273

(22) Filed: Apr. 4, 2018

(65) Prior Publication Data

US 2018/0290207 A1 Oct. 11, 2018

(30) Foreign Application Priority Data

Apr. 6, 2017 (JP) ..... 2017-076160

(51) Int. Cl.

| | |
|---|---|
| ***B22D 17/32*** | (2006.01) |
| ***B22D 17/20*** | (2006.01) |
| ***B22D 2/00*** | (2006.01) |
| ***B22D 17/12*** | (2006.01) |

(52) U.S. Cl.

CPC ..... *B22D 17/32* (2013.01); *B22D 2/00* (2013.01); *B22D 17/12* (2013.01); *B22D 17/203* (2013.01)

(58) Field of Classification Search

CPC ..... B22D 17/10; B22D 17/20; B22D 17/203; B22D 17/32; B22D 2/00

USPC ..... 164/151, 155.1, 155.3, 303, 312, 314

See application file for complete search history.

(56) References Cited

U.S. PATENT DOCUMENTS

| | | | |
|---|---|---|---|
| 5,182,716 | A | 1/1993 | Stroud, III et al. |
| 2001/0044671 | A1 | 11/2001 | Yokoyama et al. |
| 2005/0028961 | A1 | 2/2005 | Toyoshima et al. |
| 2015/0000856 | A1 | 1/2015 | Erhard et al. |

FOREIGN PATENT DOCUMENTS

| | | |
|---|---|---|
| JP | S60-234816 | 11/1985 |
| JP | H04-232717 | 8/1992 |
| JP | H08-80554 | 3/1996 |
| JP | 2001-314954 | 11/2001 |
| JP | 2003-148402 | 5/2003 |
| JP | 2004-330267 | 11/2004 |

OTHER PUBLICATIONS

English Language Abstract of JP 2003-148402 published May 21, 2003.

Japanese Office Action issued in JP 2017-076160 dated Dec. 19, 2017.

*Primary Examiner* — Kevin P Kerns

(74) *Attorney, Agent, or Firm* — DLA Piper LLP US

(57) ABSTRACT

In an injection cylinder which can be connected with a plunger, the internal portion of the cylinder part is partitioned by a piston into a rod-side chamber on the side of the piston rod and a head-side chamber on the opposite side. An accumulator can supply a hydraulic fluid to the head-side chamber. A head-use pressure sensor can detect a pressure of the head-side chamber. A flow control valve can control a flow rate of the hydraulic fluid discharged from the rod-side chamber. A control device includes an OP control part which starts open control driving the flow control valve to the opening direction after the start of supply of the hydraulic fluid from the accumulator to the head-side chamber conditional on the detection pressure of the head-use pressure sensor rising up to the predetermined set value.

9 Claims, 15 Drawing Sheets

Tb1

| D | V |
|---|---|
| $D_0$ | $V_0$ |
| $D_1$ | $V_1$ |
| ⋮ | ⋮ |
| $D_{i-1}$ | $V_{i-1}$ |
| $D_i$ | $V_i$ |

Tb2

| t | Dt |
|---|---|
| $tt_0$ | $Dt_0$ |
| $tt_1$ | $Dt_1$ |
| ⋮ | ⋮ |
| $tt_{m-1}$ | $Dt_{m-1}$ |
| $tt_m$ | $Dt_m$ |

$$ST24: Cv = Cvd1 + (Cvd2 - Cvd1) \times \frac{Vt - Vd1}{Vd2 - Vd1}$$

INJECTION APPARATUS AND MOLDING MACHINE

CROSS-REFERENCE TO RELATED APPLICATION(S)

This application claims the benefit of priority from Japanese Patent Application No. 2017-076160, filed on Apr. 6, 2017. The entirety of the above-listed application is incorporated herein by reference.

TECHNICAL FIELD

The present disclosure relates to an injection apparatus and a molding machine. The molding machine is for example a die-cast machine or injection molding machine.

BACKGROUND ART

As an injection apparatus, there is known an apparatus which uses an injection cylinder to drive a plunger pushing out a molding material into a die (for example Patent Literature 1). The speed of the injection cylinder (in other words, the injection speed) is generally controlled by a meter-in circuit which controls a flow rate of a hydraulic fluid supplied to the injection cylinder and/or a meter-out circuit which controls a flow rate of a hydraulic fluid discharged from the injection cylinder. The meter-in circuit or meter-out circuit has a flow control valve and usually is feedback controlled based on the speed of the plunger.

The injection speed exerts a large influence upon the quality of the molded article and is suitably set considering various conditions. For example, the injection speed, in an initial stage of injection, is made a low injection speed which is relatively low in speed in order to suppress entrapment of air by the molding material. After that, it is made a high injection speed which is relatively high in speed for the purpose of for example filling the molding material in the die without delay before solidification of the molding material.

CITATION LIST

Patent Literature

Patent Literature 1: Japanese Patent Publication No. 2004-330267A

SUMMARY OF INVENTION

Technical Problem

In recent years, in order to improve the quality of the molded article, higher precision speed control has been demanded. Further, again, in order to improve the quality, the way (waveform) the injection speed is set has become diversified. As a result, for example, it is sometimes difficult to respond to the demand for high precision speed control at the time of start of injection.

Solution to Problem

An injection apparatus according to one aspect of the present disclosure has an injection cylinder which has a piston rod connectable to a plunger capable of sliding in a sleeve communicated with an interior of the die, a piston fixed to the piston rod, and a cylinder part slidably accommodating the piston, in which the internal portion of the cylinder part is partitioned by the piston into a rod-side chamber on the piston rod side and a head-side chamber on the opposite side; a liquid pressure source which can supply a hydraulic fluid to the head-side chamber; a head-use pressure sensor which can detect a pressure of the head-side chamber; a flow control valve which can control a flow rate of the hydraulic fluid discharged from the rod-side chamber; and a control device which includes an open control part starting open control driving the flow control valve to an opening direction after the start of supply of the hydraulic fluid from the liquid pressure source to the head-side chamber conditional on a detection pressure of the head-use pressure sensor rising up to a predetermined set value.

In one example, the injection apparatus further has an input device which accepts an operation by the user. The flow control valve is an overlap type which positions a valve element at a position in accordance with a command value of an input control command, keeps a port closed as it is even if the valve element moves at the time when the valve element is located at a predetermined overlapping section, and makes the port begin opening by the valve element passing through the overlapping section. The control device further has a storage part which holds characteristic information linking a command value of the control command to the flow control valve and the speed of the plunger including also movement of the plunger caused due to clearance flow even when the valve element is located in the overlapping section, a target speed setting part which sets a target speed of the plunger based on an operation with respect to the input device, and a command value setting part which sets a command value of the control command output by the open control part in the open control by specifying the command value of the control command to the flow control valve corresponding to the target speed set by the target speed setting part based on the characteristic information.

In one example, the injection apparatus has an accumulator as the liquid pressure source and an accumulator-use pressure sensor which detects the pressure of the accumulator. The control device further has a correction part which makes the command value of the control command output by the open control part change between cycles so that the opening of the flow control valve in the open control becomes larger as the detection pressure of the accumulator-use pressure sensor at a predetermined point of time before the start of the open control is lower.

In one example, the correction part makes the command value of the control command output by the open control part change between cycles by correcting the characteristic information referred to by the command value setting part so that the speed of the plunger linked with the command value of the control command becomes lower as the detection pressure of the accumulator-use pressure sensor at the predetermined point of time is lower.

In one example, the injection apparatus further has a position sensor capable of detecting the position of the plunger. The control device further has an information updating part which updates the characteristic information based on a command value of the control command output in the open control and on the speed detected by the position sensor in the open control.

In one example, the control device further has a quality judgment part which judges whether a difference between the position of the plunger calculated based on the target speed set by the target speed setting part and the position of the plunger detected by the position sensor at the point of the end of the open control is within a predetermined permissible range. The information updating part updates the characteristic information based on the command value and speed in the open control only at the time of judgment by the quality judgment part that the difference is in the permissible range.

In one example, the injection apparatus further has a position sensor capable of detecting the position of the plunger, and a display device which displays an image. The control device has a quality judgment part which judges whether the difference between the position of the plunger calculated based on the target speed set by the target speed setting part and the position of the plunger detected by the position sensor at the point of the end of the open control exceeds a predetermined threshold value and has a display control part which makes the display device display a predetermined alert image when judging that the difference exceeds the threshold value.

In one example, the apparatus further comprises a position sensor capable of detecting the position of the plunger. The control device further comprises a feedback control part which performs, continuing from the open control, feedback control of the flow control valve based on the detection value of the position sensor so that the target speed set by the target speed setting part is realized.

An injection apparatus according to another aspect of the present disclosure has an injection cylinder which has a piston rod connectable to a plunger capable of sliding in a sleeve communicated with an interior of a die, a piston fixed to the piston rod, and a cylinder part slidably accommodating the piston, in which the internal portion of the cylinder part is partitioned by the piston to a rod-side chamber on the piston rod side and a head-side chamber on the opposite side; a liquid pressure source which can supply a hydraulic fluid to the head-side chamber; a rod-use pressure sensor which can detect a pressure of the rod-side chamber; a flow control valve which can control a flow rate of the hydraulic fluid discharged from the rod-side chamber; and a control device which includes an open control part starting open control driving the flow control valve to an opening direction after a start of supply of the hydraulic fluid from the liquid pressure source to the head-side chamber conditional on the detection pressure of the rod-use pressure sensor rising up to the predetermined set value.

A molding machine according to an aspect of the present disclosure has the injection apparatus described above.

Advantageous Effects of Invention

According to the above configurations, a precision of speed control at the start of injection can be improved.

DESCRIPTION OF EMBODIMENTS

<Schematic Configuration of Injection Apparatus>

Figure 1:
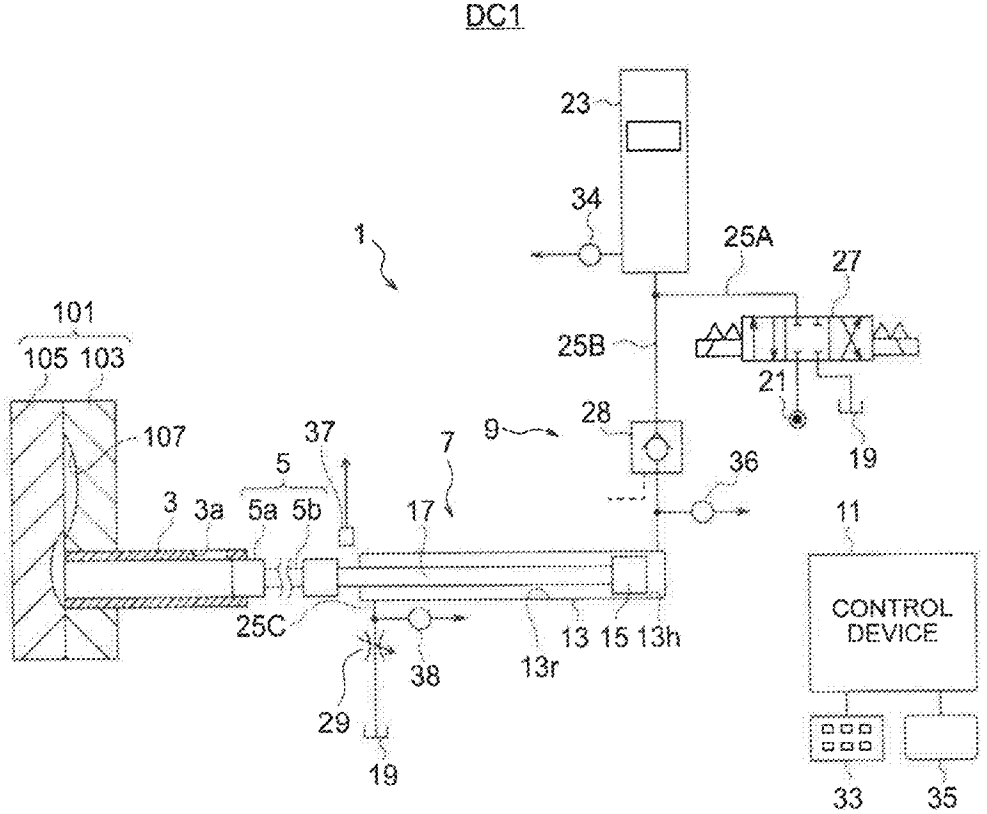
FIG. 1 A schematic view showing principal parts of a die-cast machine having an injection apparatus according to an embodiment of the present disclosure.

FIG. 1 is a schematic view showing the configuration of principal parts of a die-cast machine DC1 having an injection apparatus 1 according to an embodiment of the present disclosure. Note that, in the following description, sometimes the left and right direction on the paper surface (forward/backward travelling direction of the plunger 5 which will be explained later) will be referred to as the forward/backward direction.

The die-cast machine DC1 is a machine which injects molten metal (metal material in a molten state) as the molding material into a die 101 (cavity 107) and makes that molten metal solidify in the die 101 thereby manufacturing a die-cast article (molded article). The die 101 for example includes a fixed die 103 and movable die 105.

Specifically, the die-cast machine DC1 for example has a not shown clamping device which performs opening/closing and clamping of the die 101, an injection apparatus 1 injecting molten metal to an internal portion of the clamped die 101, a not shown ejection device which ejects the die-cast article from the fixed die 103 or movable die 105, and a control device for controlling them. The configurations other than the injection apparatus 1 may be basically the same as various conventional configurations, so their explanation will be omitted.

The injection apparatus 1 for example has a sleeve 3 communicated with the cavity 107, a plunger 5 which pushes out the molten metal in the sleeve 3 into the cavity 107, an injection cylinder 7 for driving the plunger 5, a hydraulic pressure device 9 for supplying a hydraulic fluid to the injection cylinder 7, and a control device 11 which controls the hydraulic pressure device 9. For the injection apparatus 1 as well, except for the configuration of the control device 11 (operation from another viewpoint), various conventional configurations can be applied. The configuration of the injection apparatus 1 is for example as follows.

The sleeve 3 is for example a tubular member which is inserted into the fixed die 103. The plunger 5 has a plunger tip 5*a* which can slide in the forward/backward direction in the sleeve 3 and a plunger rod 5*b* which is fixed to the plunger tip 5*a*. By the molten metal being supplied into the sleeve 3 from a molten metal supplying hole 3*a* formed in the upper surface of the sleeve 3 and by the plunger tip 5*a* sliding (advancing) in the sleeve 3 toward the cavity 107, the molten metal is injected into the cavity 107.

The injection cylinder 7 for example has a cylinder part 13, a piston 15 capable of sliding inside the cylinder part 13, and a piston rod 17 which is fixed to the piston 15 and extends outward from the cylinder part 13.

The cylinder part 13 is for example a tubular body with a circular cross-sectional shape of the internal portion and with a constant diameter in the longitudinal direction. The internal portion of the cylinder part 13 is divided by the piston 15 to a rod-side chamber 13*r* on the side where the piston rod 17 extends outward and to a head-side chamber 13*h* on the opposite side. By hydraulic fluid being selectively supplied to the head-side chamber 13*h* and rod-side chamber 13*r*, the piston 15 slides in the forward/backward direction inside the cylinder part 13.

The injection cylinder 7 is for example coaxially arranged with respect to the plunger 5 behind the latter. Further, the piston rod 17 is connected through a coupling (notation is omitted) to the plunger 5. The cylinder part 13 is provided in a fixed manner with respect to a not shown clamping device etc. Accordingly, by movement of the piston 15 relative to the cylinder part 13, the plunger 5 moves forward or moves backward inside the sleeve 3.

Note that, in the shown example, the injection cylinder 7 is configured as single barrel type having only the piston 15 as the piston. However, the injection cylinder 7 may be configured as a so-called boost type as well. That is, although not particularly shown, the injection cylinder 7 may have a booster cylinder part which is communicated with the head-side chamber 13*h* in the cylinder part 13 and a booster piston capable of sliding in the booster cylinder part. The booster piston, compared to the pressure receiving area receiving the pressure from the head-side chamber 13*h*, has a large pressure receiving area on the opposite side and thereby exerts a boosting action.

The hydraulic pressure device 9 for example has a tank 19 for storing the hydraulic fluid, a pump 21 capable of pumping out the hydraulic fluid in the tank 19, an accumulator 23 capable of releasing the accumulated hydraulic fluid, a plurality of channels (first channel 25A to third channel 25C) which connect these and the injection cylinder 7 to each other, a plurality of valves (accumulation control valve 27, in-side valve 28, and flow control valve 29) for controlling the flow of the hydraulic fluid in the plurality of channels. Note that, in FIG. 1, for convenience of illustration, the tank 19 is shown at two positions. In actuality, the two parts may be unified into one tank 19.

The tank 19 is for example an atmospheric reservoir and holds the hydraulic fluid under atmospheric pressure. The tank 19 supplies the hydraulic fluid through the pump 21 and accumulator 23 to the injection cylinder 7 and holds the hydraulic fluid discharged from the injection cylinder 7.

The pump 21 is driven by a not shown electric motor and pumps out the hydraulic fluid. The pump may be a rotary pump, plunger pump, fixed displacement pump, variable displacement pump, monodirectional pump, bidirectional (two directions) pump, or other suitable system. Also, the electric motor driving the pump 21 may be a DC motor, AC motor, induction motor, synchronous motor, servo motor, or other suitable system. The pump 21 (electric motor) may be driven all the time during the operation of the die-cast machine DC1 or may be driven according to need. The pump 21 for example contributes to the supply of the hydraulic fluid with respect to the accumulator 23 (accumulation of the accumulator 23) and to the supply of the hydraulic fluid with respect to the injection cylinder 7.

The accumulator 23 may be configured as a suitable system and is for example a weight loaded type, spring loaded type, gas loaded type (including air loaded type), cylinder type (piston type), or bladder type. In the shown example, the accumulator 23 is a cylinder type and, although notation is not particularly attached, has a cylinder part and a piston for dividing the cylinder part to a liquid chamber and a gas chamber. In the accumulator 23, the pressure is accumulated by supply of the hydraulic fluid to the liquid chamber. It can release that accumulated hydraulic fluid having a relatively high pressure to the injection cylinder 7.

The first channel 25A connects the pump 21 and the accumulator 23 (its liquid chamber). Due to this, for example, it is possible to supply hydraulic fluid from the pump 21 to the accumulator 23 to build up pressure in the accumulator 23.

The second channel 25B connects the accumulator 23 (its liquid chamber) and the head-side chamber 13*h*. Due to this, for example, it is possible to supply hydraulic fluid from the accumulator 23 to the head-side chamber 13*h* and move the piston 15 forward.

The third channel 25C connects the rod-side chamber 13*r* and the tank 19. Due to this, for example, it is possible to hold the hydraulic fluid discharged from the rod-side chamber 13*r* along with the forward movement of the piston 15 in the tank 19.

Note that, in FIG. 1, among the channels provided in the hydraulic pressure device 9, representative channels relating to the characteristic features of the present embodiment are exemplified. In actuality, however, the hydraulic pressure device 9 has various other not shown channels. For example, the hydraulic pressure device 9 has a channel which supplies the hydraulic fluid from the pump 21 to the rod-side chamber 13*r* in order to move the piston 15 backward.

The shown or not shown plurality of channels are for example configured by steel pipes, flexible hoses, or metal blocks. The plurality of channels may be suitably partially made common. For example, in the example in FIG. 1, the first channel 25A and second channel 25B are made common in a portion on the accumulator 23 side.

The accumulation control valve 27 is provided at the first channel 25A and for example contributes to permission and prohibition of supply of the hydraulic fluid from the pump 21 to the accumulator 23. The accumulation control valve 27 is for example configured by a direction control valve. More specifically, for example, it is configured by 4-port 3-position switching valve which is driven by a spring and electromagnet. The accumulation control valve 27, for example, prohibits the flow between the accumulator 23 and the tank 19 and pump 21 at one position (for example neutral position). At another position, it permits the flow from the pump 21 to the accumulator 23 and prohibits the flow from the accumulator 23 to the tank 19. Further, at still another position, it prohibits the flow from the pump 21 to the accumulator 23 and permits the flow from the accumulator 23 to the tank 19.

The in-side valve 28 is provided at the second channel 25B and for example contributes to the permission and prohibition of supply of the hydraulic fluid from the accumulator 23 to the head-side chamber 13*h*. The in-side valve 28 is for example configured by a pilot type check valve. At the time when a pilot pressure is not introduced, the in-side valve 28 permits the flow of the hydraulic fluid from the accumulator 23 to the head-side chamber 13*h* and prohibits the flow in the opposite direction. On the other hand, at the time when a pilot pressure is introduced, it prohibits the flow in the two directions.

The flow control valve 29 is provided at the third channel 25C and for example contributes to the control of the flow rate of the hydraulic fluid from the rod-side chamber 13*r* to the tank 19. According to this flow rate control, the forward speed of the piston 15 is controlled. That is, the flow control valve 29 configures a so-called meter-out circuit. The flow control valve 29 is for example configured by a flow rate regulating valve with pressure compensation capable of keeping the flow rate constant even if pressure fluctuation occurs. Further, the flow control valve 29 is for example configured by a servo valve which is used in a servo mechanism and can smoothly (steplessly) change the flow rate in accordance with the input signal.

Note that, a meter-in circuit may be provided as well in addition to the meter-out circuit. For example, although not particularly shown, a flow control valve having the same configuration as the flow control valve 29 may be provided between the accumulator 23 and the head-side chamber 13*h*. The in-side valve 28 may have the function of adjusting the flow rate as well.

In FIG. 1, among the valves provided in the hydraulic pressure device 9, representative valves relating to the characteristic features of the present embodiment are exemplified. In actuality, however, the hydraulic pressure device 9 has various other not shown valves. For example, the hydraulic pressure device 9 has a valve for permitting and prohibiting the supply of the hydraulic fluid from the pump 21 to the rod-side chamber 13*r*. Further, for example, the hydraulic pressure device 9 may have a channel and valve as well so that the hydraulic fluid can be supplied from the pump 21 to the head-side chamber 13*h*.

The control device 11, for example, although particularly not shown, includes a CPU, ROM, RAM, external memory device, etc. The control device 11 outputs control signals (control commands) for controlling the portions based on input signals according to a program which is stored in advance. Note that, the control device 11 may be configured as a control device of the injection apparatus 1 or may be configured as a control device of the die-cast machine DC1 which controls not only the operation of the injection apparatus 1, but also the operations of a not shown clamping device and not shown extrusion device and so on. Further, the hardware thereof may be dispersed to a plurality of positions (plurality of housings) or may be configured as a set.

The control device 11 receives the input of signals from for example an input device 33 accepting an input operation by the operator, an ACC-use pressure sensor 34 for detecting the pressure of the accumulator 23 (ACC pressure), a head-use pressure sensor 36 for detecting the pressure of the head-side chamber 13*h* (head pressure), a rod-use pressure sensor 38 for detecting the pressure of the rod-side chamber 13*r* (rod pressure), and a position sensor 37 for detecting the position of the plunger 5 (piston rod 17). The control device 11 outputs signals to for example a display device 35 displaying information to the operator, a not shown electric motor (strictly speaking, the driver thereof) driving the pump 21, and various types of valves (for example the shown valves or a valve controlling the pilot pressure with respect to the shown valves).

The input device 33 and display device 35 may be given suitable configurations. Part or all of them may be integrally configured as well. For example, the input device 33 and display device 35 may include a touch panel and mechanical switches. The input device 33 for example accepts an operation for setting a low injection speed, a high injection speed, casting pressure, and other molding conditions and an operation for instructing the start of the molding cycle to the injection apparatus 1.

The ACC-use pressure sensor 34 for example detects the pressure of the liquid chamber of the accumulator 23. Note that, the ACC-use pressure sensor 34 may be configured so as to detect the pressure in a gas chamber in the accumulator 23 as well. The ACC-use pressure sensor 34 may be provided so as to directly detect the pressure of the liquid chamber as shown in the diagram or provided so as to detect the pressure of the channel having a pressure equal to the pressure of the liquid chamber unlike the illustration. As the configuration of the ACC-use pressure sensor 34, various known configurations may be employed.

The head-use pressure sensor 36, as shown in the diagram, may be provided so as to detect the pressure of the channel having an equal pressure to the pressure of the head-side chamber 13*h* or may be provided so as to directly detect the pressure of the head-side chamber 13*h* unlike the illustration. As the configuration of the head-use pressure sensor 36, various known configurations may be employed.

The rod-use pressure sensor 38, as shown in the diagram, may be provided so as to detect the pressure of the channel having an equal pressure to the pressure of the rod-side chamber 13*r* or may be provided so as to directly detect the pressure of the rod-side chamber 13*r* unlike the illustration. As the configuration of the rod-use pressure sensor 38, various known configurations may be employed.

The position sensor 37, for example, detects the position of the piston rod 17 relative to the cylinder part 13 and indirectly detects the position of the plunger 5. The configuration of the position sensor 37 may be a suitable one. For example, the position sensor 37 may be one configures a magnetic or optical linear encoder together with a not shown scale portion which is fixed to the piston rod 17 and extends in the axial direction of the piston rod 17 or may be configured by a laser length measuring device for measuring the distance relative to the member fixed to the piston rod 17.

Note that, the position sensor 37 alone or the position sensor 37 and the control device 11 in combination can count the time while repeatedly detecting the position so as to acquire the differential value of the position constituted by the speed of the plunger 5. Accordingly, it is also possible to view the position sensor 37 as a speed sensor capable of substantially detecting speed.

<Outline of Basic Operation of Injection Apparatus>

Figure 2:
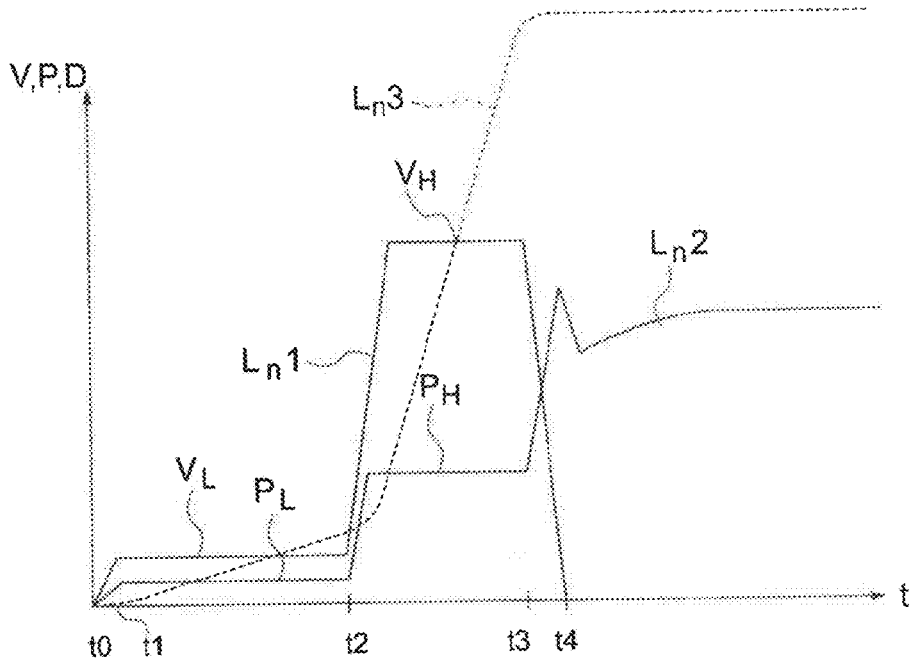
FIG. 2 A graph for explaining an outline of an example of basic operation of the injection apparatus in FIG. 1.

FIG. 2 is a graph for explaining an outline of an example of the basic operation of the injection apparatus.

In the graph, an abscissa indicates the time "t", and an ordinate indicates an injection speed V, injection pressure P, and position D of the plunger 5. The injection speed V is the speed of the plunger 5. The injection pressure P is the pressure which is given to the molten metal by the plunger 5. The position D is, here, the position of the plunger 5 with reference to the position of the injection start point (point of time, t0). From another viewpoint, it is the movement distance D of the plunger 5 from the injection start point and consequently the integrated value of the injection speed V. In the graph, a line Ln1 indicates a change of the injection speed V along with the elapse of time, a line Ln2 indicates the change of the injection pressure P along with the elapse of time, and a line Ln3 indicates the change of the position D along with the elapse of time.

The injection apparatus 1, for example, when taking a general view, performs low speed injection (generally t0 to t2), high speed injection (generally t2 to t3), and pressure increase (boosting, generally t3 or t4 on) in order. The operations in these processes are for example as follows.

(Low Speed Injection)

When the fixed die 103 and movable die 105 finish being clamped by the not shown clamping device and molten metal is supplied to the sleeve 3, the control device 11 starts the forward movement of the plunger 5 (point t0) and makes the plunger 5 move forward at a relatively low speed of the low injection speed $V_L$ (points t1 to t2). Due to this, entrapment of air by the molten metal is suppressed while the molten metal in the sleeve 3 is pushed out toward the cavity 107. The low injection speed $V_L$ may be suitably set. However, for example, it is less than 1 m/s. In general, it is about 0.2 to 0.3 m/s in many cases and sometimes is made about 0.1 m/s as well. Further, the low injection speed $V_L$ is for example a constant value. However, suitable speed control may be carried out as well. In the low speed injection, the injection pressure becomes relatively low (low speed injection pressure $P_L$) since the injection speed is relatively low.

For the operation as described above, the control device 11, specifically, for example, suspends the introduction of the pilot pressure closing the in-side valve 28 so as to supply the hydraulic fluid from the accumulator 23 through the second channel 25B to the head-side chamber 13*h*. Due to this, the piston 15 moves forward and consequently the plunger 5 moves forward. At this time, the hydraulic fluid in the rod-side chamber 13*r* which is reduced in capacity along with the forward movement of the piston 15 is for example discharged through the third channel 25C to the tank 19. The speed of the plunger 5 is controlled by the meter-out circuit (flow control valve 29). The meter-in circuit may be used together as already explained.

Note that, the hydraulic fluid discharged from the rod-side chamber 13*r* is refluxed to the head-side chamber 13*h* through a not shown channel (run-around circuit). The meter-out circuit (flow control valve 29) may control the flow rate of this reflux as well.

(High Speed Injection)

When the plunger 5 reaches a predetermined high speed switching position (point t2), the control device 11 makes the plunger 5 move forward at a relatively high speed of the high injection speed $V_H$. Due to this, for example, the molten metal is speedily filled in the cavity 107 without delay before the solidification of the molten metal. The high injection speed $V_H$ may be suitably set. However, it is for example 1 m/s or more. The high injection speed $V_H$ is for example a constant value. However, suitable speed control may be carried out as well. In the high speed injection, since the injection speed is relatively high, the injection pressure becomes a high speed injection pressure $P_H$ higher than the low speed injection pressure $P_L$.

For the operation as described above, the control device 11, specifically, for example, makes the opening of the flow control valve 29 of the meter-out circuit large while continuing the supply of the hydraulic fluid from the accumulator 23 to the head-side chamber 13*h* successively from the low speed injection. The hydraulic fluid in the rod-side chamber 13*r* may be discharged to the tank 19 in the same way as the low speed injection or may be refluxed through a not shown channel to the head-side chamber 13*h*. The speed of the plunger 5 is controlled by the meter-out circuit (flow control valve 29). The meter-in circuit may be used together as already explained.

(Deceleration, Boosting, and Pressure-Holding)

As a result of the high speed injection, when the cavity 107 is roughly filled with the molten metal (point t3), the pressure of the molten metal rises and the plunger 5 decelerates. Note that, deceleration control may be carried out by the meter-out circuit (flow control valve 29) at a suitable timing as well.

After that, the plunger 5 (substantially) stops (point t4) and the pressure of the molten metal rises and reaches the casting pressure (final pressure) (boosting process). Further, the casting pressure is maintained (pressure-holding process). Note that, the casting pressure is the pressure of the molten metal at the time when the force applied to the plunger 5 due to the pressure difference between the rod-side chamber 13*r* and the head-side chamber 13*h* and the reaction force that the plunger 5 receives from the molten metal are balanced. At this time, the pressure of the rod-side chamber 13*r* may be made the tank pressure or may be determined to a suitable pressure by prohibiting the discharge of the hydraulic fluid from the rod-side chamber 13*r* at a suitable timing during the boosting process. Further, the pressure of the head-side chamber 13*h* is equal to the pressure of the accumulator 23 in the example in FIG. 1 (single barrel type injection cylinder 7) or is equal to the pressure obtained by suitably boosting the pressure of the accumulator 23 by the boosting piston in the boosting type injection cylinder.

Further, when the molten metal solidifies, the die is opened by the not shown clamping device, the die-cast article is ejected from the die by a not shown ejection device, the plunger 5 is retracted by supply of the hydraulic fluid to the rod-side chamber 13*r*, and so on.

<Servo Configuration for Speed Control>

As explained above, speed control by the flow control valve 29 is carried out at least from the start of injection to the end of the high speed injection. This speed control is basically carried out as feedback control (except for part of the period which will be explained later). The feedback control is for example directly carried out as position feedback control. Substantially, speed feedback control is carried out. Specifically, this is as follows FIG. 3A is a conceptual diagram showing information relating to the target speed which is generated by the control device 11.

The control device 11 accepts setting of the target speed by the operator through the input device 33. The target speed is for example set with respect to the position D of the plunger 5. Specifically, for example, the control device 11 accepts a plurality of positions D of the plunger 5 and input of the target speeds at the positions D. Due to this, information linking the positions D of the plunger 5 and the target speeds is generated.

Figures 3A, 3B:
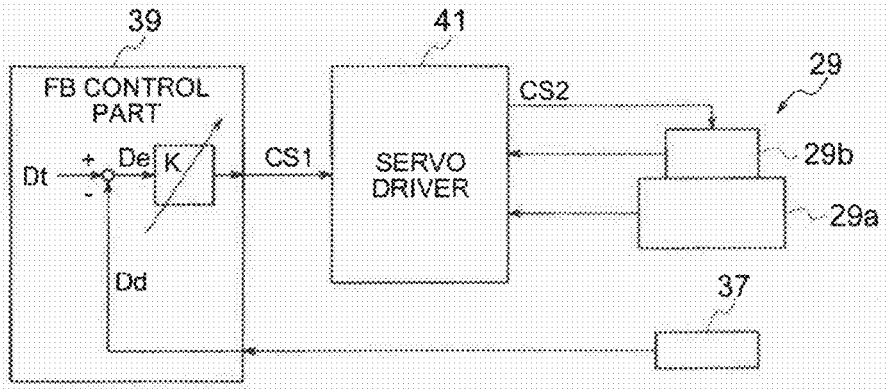
FIG. 3A is a conceptual view showing information concerned with a target speed generated by the injection apparatus in FIG. 1.
FIG. 3B is a block diagram showing an outline of the configuration concerned with feedback control of a flow control valve in the injection apparatus in FIG. 1.

A target speed table Tb1 shown on the left side on the page in FIG. 3A shows an example of information linking the positions D of the plunger 5 and the target speeds generated as described above. In the target speed table Tb1, a plurality of positions $D_0$ to $D_i$ of the plunger 5 and target speeds $V_0$ to $V_i$ at the positions are linked. The target speed table Tb1 is for example held in the RAM and/or external storage device.

Note that, the position $D_0$ is for example the position at the time of start of injection. The speed $V_0$ at this time is 0. The number (i) of the position D for which the operator sets the target speed is for example suitably set by the operator. Further, the speed between the position D and the next position D may be specified by the control device 11 according to suitable interpolation. The range of positions in which the speed becomes constant for example may be set between one position D and the next position D by setting the same target speed for the two positions D.

Next, the control device 11 converts the information (target speed table Tb1) of the target speed with respect to the position D to the information of the target position with respect to the elapsed time. A target position table Tb2 shown on the right side on the page in FIG. 3A shows an example of such converted information. In the target position table Tb2, the elapsed times (points $tt_0$ to $tt_m$) and the target positions $Dt_0$ to $Dt_m$ at the points of time are linked. The target position table Tb2 is for example held in the RAM.

The conversion from the target speed table Tb1 to the target position table Tb2 may be suitably carried out in the same way as the conventional method. For example, first, the control device 11, based on the target speed table Tb1, interpolates the target speeds for each plurality of positions D having a relatively short pitch width. Further, the control device 11 integrates the target speeds of that interpolated data by multiplying a relatively short predetermined time increment (not more than time increment of points $tt_0$ to $tt_m$). Due to this, substantially, for each elapse of time (points $tt_0$ to $tt_m$), the integrated value of target speeds from the time of start of injection to the elapsed time is calculated. That is, the target position for each elapse of time is calculated. In the process of this integration, whenever the integrated value (target position) reaches the position D of the interpolation data, the target speed to be integrated is changed.

Note that, for rising from the speed $V_0$ (V=0), for example, the target position may be specified based on the speed V obtained by interpolation (for example interpolation according to the linear function) between the speeds $V_0$ and $V_1$. Further, the conversion from the target speed table Tb1 to the target position table Tb2 may be found not according to the approximation as described above, but according to an equation as well.

The point $tt_0$ of the start of control corresponds to the point t0 of the start of injection in FIG. 2. The point $tt_m$ of the end of control corresponds to the end of the speed control of the injection. For example, it corresponds to the point t3 or point t4 in FIG. 2 or suitable point of time between the two. Note that, under the control during the molding cycle, irrespective of whether the elapsed time reaches the point $tt_m$, the speed control may be ended conditional on a predetermined factor being satisfied (for example the injection pressure reaching the predetermined pressure), and the pressure control for boosting may be started as well. The time increment of the points $tt_0$ to $tt_m$ is for example constant over the injection process. Further, the length of the time increment may be suitably set so that the injection waveform (waveform indicated by the line Ln2 in FIG. 2) is suitably realized. However, it is for example 1 ms.

FIG. 3B is a block diagram showing the configuration according to feedback control of the flow control valve 29.

This feedback system, in addition to the already explained position sensor 37 and flow control valve 29, has an FB control part 39 configured in the control device 11 and a servo driver 41 which converts a control signal CS1 from the FB control part 39 to a suitable control output CS2 and outputs the same to the flow control valve 29. Note that, the control output CS2 is based on the control signal CS1. Therefore, in the following description, sometimes the two will not be distinguished and will be referred to as the "control command CS".

The FB control part 39, based on the detection value of the position sensor 37, performs (real time) feedback control of the flow control valve 29 so that the target speed is realized. Specifically, for example, the FB control part 39 refers to the target position table Tb2, specifies the target position Dt set with respect to the elapsed time for each elapse of time, calculates a deviation De between that specified target position Dt and the position Dd detected by the position sensor 37, and outputs the control command CS of the command value in accordance with the calculated deviation. That is, the FB control part 39 substantially performs speed feedback control according to the position feedback control linking the detected position with the constantly changing target position.

Note that, the period (time increment) for performing the feedback control described above is for example the same as the time increment of the elapsed time (points $tt_0$ to $tt_m$) in the target position table Tb2 and is for example about 1 ms.

The deviation De is converted to the command value of the control command CS for example by multiplication of a predetermined proportional gain K with the deviation De. That is, in the FB control part 39, proportional control is carried out. Note that, PI control, PD control, PID control, etc. may be carried out. Fuzzy control or another control method may be suitably introduced.

The servo driver 41, for example, not only simply converts the control signal CS1 to the control output CS2, but also performs feedback control of the flow control valve 29 based on the signal indicating the degree of opening output from the flow control valve 29 so that the opening of the flow control valve 29 becomes the opening designated by the control signal CS1. That is, the servo driver 41 performs minor loop feedback control. However, the servo driver 41 for example may simply convert the control signal CS1 to the control output CS2 as well.

Note that, the servo driver 41 may be grasped as a portion of the control device 11 or a portion of the flow control valve 29 as well. Further, the servo driver 41 may be arranged together with the control device 11 or may be arranged together with the flow control valve 29. In the following description, sometimes the explanation will be given of the control of the flow control valve 29 by the control device 11 while omitting the servo driver 41.

In the example shown in FIG. 3B, the flow control valve 29 has a main valve 29*a* for opening/closing the third channel 25C and a pilot valve 29*b* for driving the main valve 29*a*. Further, a signal instructing the opening of the main valve 29*a* is output to the servo driver 41, whereby the minor loop feedback control described above is carried out. Further, a signal instructing the opening of the pilot valve 29*b* is output to the servo driver 41, whereby feedback control of a further minor loop than the above minor loop may be carried out as well.

<Overlap Characteristic of Flow Control Valve>

Figure 4A:
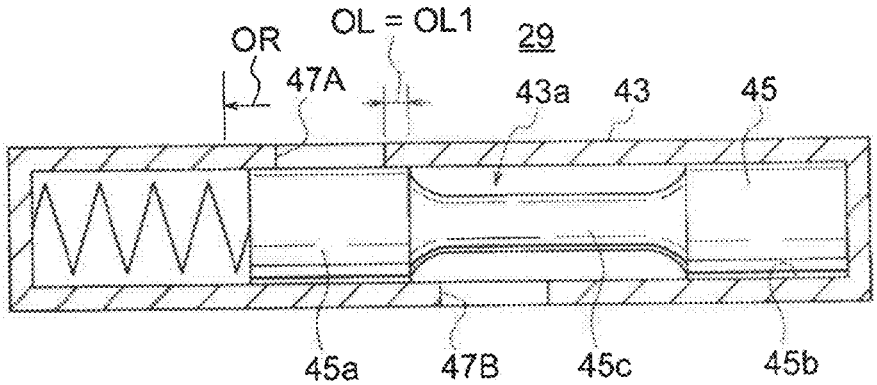
FIG. 4A to FIG. 4C are cross-sectional views for explaining the operation of the flow control valve in the injection apparatus in FIG. 1.
Figure 4B:
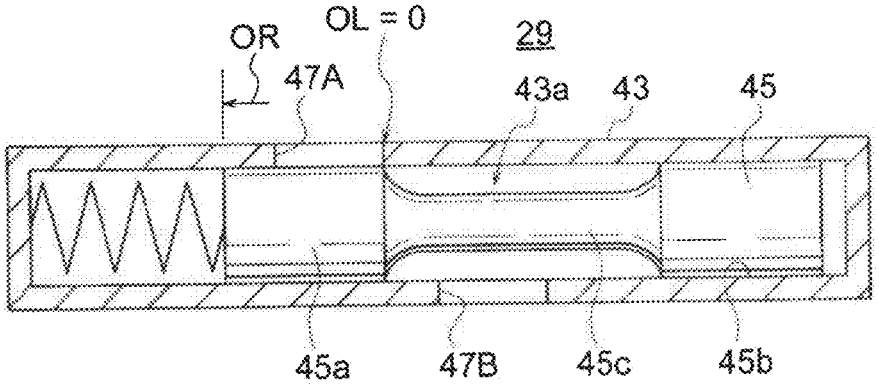
Figure 4C:
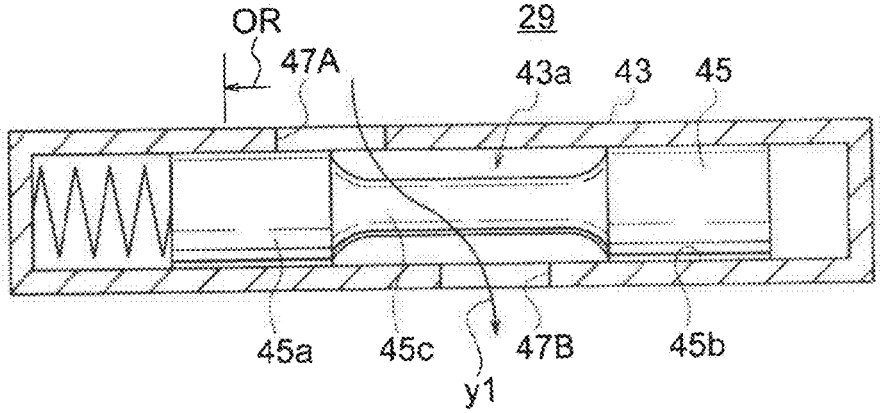

FIG. 4A to FIG. 4C are cross-sectional views schematically showing the configuration of the flow control valve 29. Note that, these diagrams are schematic ones for explaining the overlap characteristic and do not correctly show an example of the configuration or shape of the flow control valve 29.

The flow control valve 29 is for example one type of slide valve, that is, a spool type valve, and has a hollow main body 43 of the valve and a spool 45 which can slide in the main body 43 of the valve.

The hollow part 43*a* in the main body 43 of the valve extends in the right-left direction on the paper surface with a constant cross-section. Further, in the main body 43 of the valve, a first port 47A and second port 47B for communication between the hollow part 43*a* and the external portion of the main body 43 of the valve are formed. The main body 43 of the valve is for example assembled in the third channel 25C so that the first port 47A is connected to the rod-side chamber 13*r* and the second port 47B is connected to the tank 19. Note that, the destinations of connections of the two ports may be vice versa.

The spool 45 is substantially a shaft-shaped member and for example has a first land portion 45*a* and second land portion 45*b* which have a bit smaller cross-sectional shape than the cross-sectional shape of the hollow part 43*a* (the shape of the cross-section perpendicular to the right and left direction on the paper surface) and a small diameter portion 45*c* which is positioned between these land portions and has a smaller diameter than the land portions. The spool 45 can move in the hollow part 43*a* in the right-left direction on the page.

FIG. 4A shows a state where the spool 45 is located at a predetermined reference position (neutral point) and the flow control valve 29 is closed. At this position, the first land portion 45*a*, in the movement direction of the spool 45, is positioned at the center with respect to the first port 47A and closes the first port 47A. Due to this, the flow between the first port 47A and the second port 47B is prohibited. At this time, the first land portion 45*a*, in the movement direction etc. of the spool 45, not only closes the first port 47A, but also overlaps with the main body 43 of the valve on the periphery of the first port 47A. This overlap amount will be defined as OL. The overlap amount OL at the time of FIG. 4A will be defined as OL1.

FIG. 4B shows a state where the spool 45 is displaced a little from the position in FIG. 4A to the opening position. Even when the spool 45 is displaced from the position in FIG. 4A, in the state in FIG. 4A, the first land portion 45*a* overlaps the periphery of the first port 47A with the overlap amount OL1, therefore the first port 47A is not immediately opened. Specifically, as shown in FIG. 4B, up to the position at which the overlap amount OL becomes 0, the first port 47A is closed by the first land portion 45*a* as it is (not opened).

FIG. 4C shows a state where the spool 45 is further displaced from the position in FIG. 4B to the opening position side. In this state, the state where the first port 47A has been closed by the first land portion 45*a* is released. That is, the first port 47A is opened. Due to this, as indicated by an arrow y1, the flow from the first port 47A to the second port 47B is permitted. Further, the opening of the flow control valve 29 is continuously adjusted by displacement of the spool 45 between the position shown in FIG. 4B and the position shown in FIG. 4C. The flow rate is continuously controlled by this.

In this way, in the flow control valve 29, at the time when the spool 45 is located in the predetermined overlapping section OR (only the boundary on the left side on the paper surface is shown), even when the spool 45 is displaced, the first port 47A is not opened. When the spool 45 has passed through the overlapping section OR, the first port 47A is opened. Such a state of overlap of the valve element and the main body of the valve where the valve element (spool 45) is displaced a little from the reference position and then the port is opened first is called OVERLAP. By employing such OVERLAP, for example, when the spool 45 is located at the reference position, the flow of the hydraulic fluid can be more reliably shut off.

A driving force for driving the spool 45 may be directly given from a solenoid (linear electric motor) or may be given by liquid pressure from the pilot valve driven by the solenoid (example in FIG. 3B). The flow control valve 29 moves the spool 45 to a position in accordance with the command value of the input control command CS.

Figure 5:
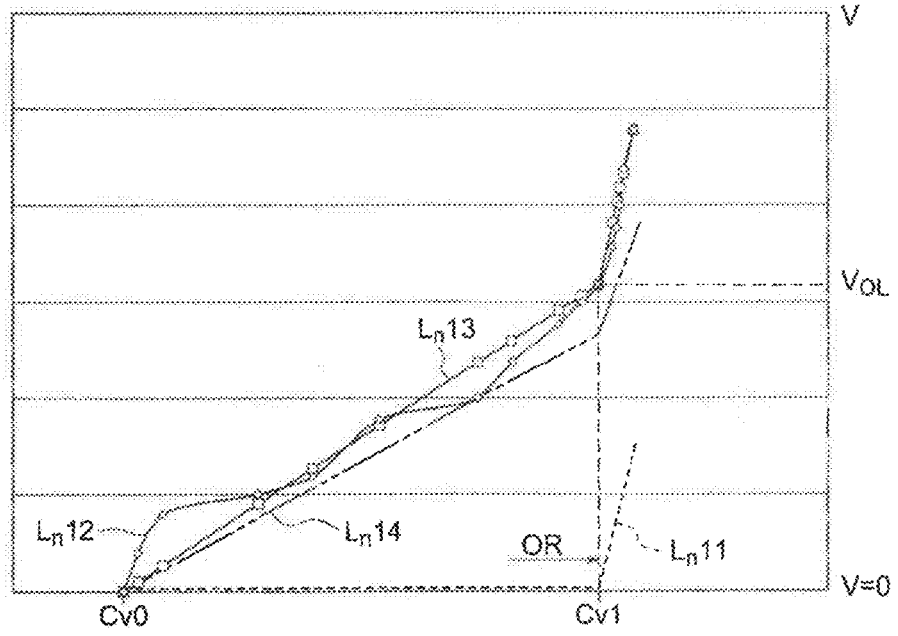
FIG. 5 A graph showing flow rate characteristics of the flow control valve in the injection apparatus in FIG. 1.

FIG. 5 is a graph showing a flow rate characteristic of the overlap type flow control valve 29.

In this graph, the abscissa indicates the command value Cv of the control command CS input to the flow control valve 29. Note that, the flow control valve 29 positions the spool 45 at a position in accordance with the command value Cv. Therefore, from another viewpoint, the abscissa indicates the position of the spool 45. In FIG. 5, the ordinate indicates the speed of the plunger 5. Note that, the speed of the plunger 5 is proportional to the flow rate of the hydraulic fluid discharged through the flow control valve 29 from the rod-side chamber 13*r*. Therefore, from another viewpoint, the ordinate indicates the flow rate in the flow control valve 29.

The lower end of the ordinate corresponds to V=0. On the abscissa, according to the configuration of the flow control valve 29, positive/negative and absolute values are suitably plotted. Accordingly, for example, even when the command values Cv and the speeds V have linear relationships, this does not always mean proportionality. Note, in the following description, for convenience of explanation, sometimes the change of the command value Cv is expressed assuming that the value of the command value Cv increases toward the right side on the paper surface.

Cv=Cv0 corresponds to the state where OL=OL1 in FIG. 4A. Cv=Cv1 corresponds to the state where OL=0 in FIG. 4B. That is, the range from Cv0 to Cv1 corresponds to the state where the spool 45 is positioned in the overlapping section OR, and the range on the right side from Cv1 on the paper surface corresponds to the state where the spool 45 has passed through the overlapping section OR and the first port 47A is opened.

A line Ln11 indicates an ideal flow rate characteristic of the flow control valve 29. A line Ln12 indicates the measured flow rate characteristic of the flow control valve 29. A line Ln13 indicates the approximate value with respect to the line Ln12.

As already explained, when the spool 45 is positioned in the overlapping section OR, the first port 47A is closed by the first land portion 45*a*. Accordingly, as indicated by the line Ln11, ideally the speed of the plunger 5 is 0. Further, when the command value Cv exceeds Cv1, the speed V rises in accordance with the increase of the command value Cv (for example with linear relationship).

However, between the spool 45 and the inner circumferential surface of the main body 43 of the valve, there is a clearance through which the hydraulic fluid (for example oil) can penetrate. Due to the provision of such a clearance, smooth movement of the spool 45 with respect to the main body 43 of the valve becomes possible. The size of this clearance is suitably set according to the structure and size of the flow control valve 29. It is for example several micrometers to several tens of micrometers. Further, in the flow control valve 29, even when the spool 45 is positioned in the overlapping section OR, a flow from the first port 47A to the second port 47B is generated due to so-called clearance flow flowing in the clearance.

Accordingly, in actuality, as indicated by the line Ln12, even in the state where the spool 45 is positioned in the overlapping section OR, the speed V changes according to the displacement of the spool 45. Specifically, for example, when the spool 45 is positioned at the reference position (position corresponding to the command value Cv0), the speed V is substantially 0. When the displacement from the reference position increases, the speed V also rises. At that time, the relationship between the displacement (command value Cv) and the speed V is for example substantially linear as understood also from the line Ln13 of the approximate value. Further, the rate of change is smaller than the rate of change from opening (CV>CV1) of the first port 47A. The speed $V_{OL}$ of the plunger 5 when the spool 45 is positioned at the boundary (CV=CV1) between the overlapping section OR and the section outside of the same is a speed lower than the speed which can be set as the low injection speed $V_L$ and is for example 0.15 m/s or less or is less than 0.1 m/s.

<Problem Caused by Overlap Characteristic>

Figure 6A:
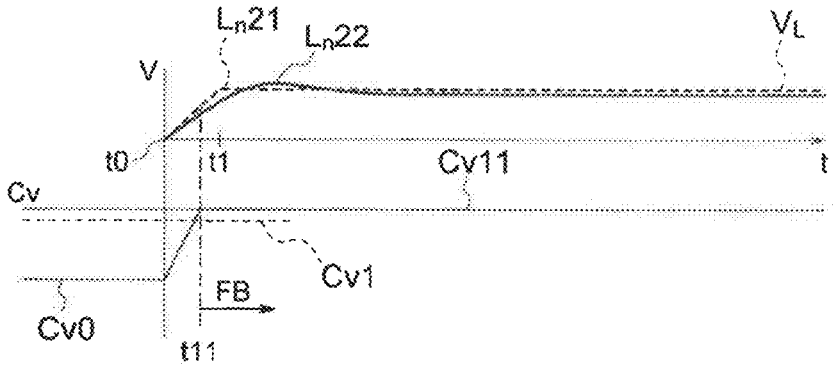
FIG. 6A to FIG. 6C are views for explaining the problem occurring according to overlap characteristics and the solution to the same.
Figure 6B:
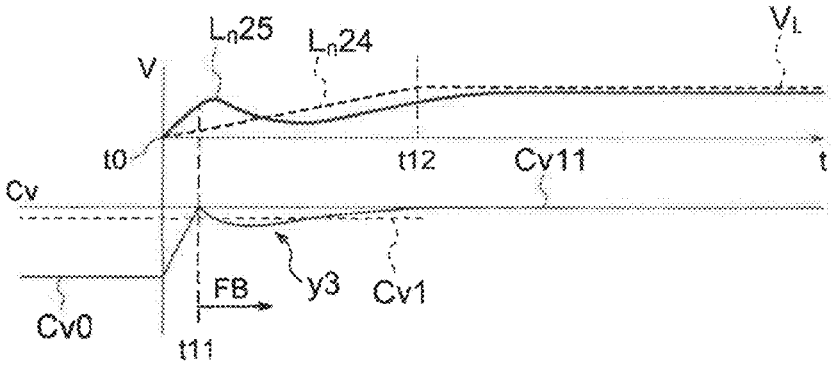

FIG. 6A and FIG. 6B are charts for explaining the problem which occurs according to the overlap characteristic as described above. In these charts, the abscissa shows the time, and the ordinate shows the injection speed V and command value Cv. Further, as understood from notations of points t0 and t1 and low injection speed $V_L$, these charts correspond to the range from the time of start of injection to the middle of the low speed injection as explained with reference to FIG. 2.

FIG. 6A is a view for explaining a control method which has been conventionally used for an injection apparatus worked by the applicant. In this view, a line Ln21 indicates the change along with time of the target value of the injection speed V set by the operator. A line Ln22 indicates the change along with time of the actual injection speed V.

As explained above, during the period where the spool 45 is positioned in the overlapping section OR, basically the first port 47A is closed by the first land portion 45*a*. Therefore, conventionally, at first, the control device 11 quickly moves the spool 45 up to the position where it passes through the overlapping section OR and smoothly raises the injection speed by this. After that (after the point t11), it performed feedback control explained with reference to FIG. 3B.

Specifically, for a relatively short time from the time of start of injection, the conventional control device 11 changes the command value Cv of the control command CS from Cv0 corresponding to the reference position to Cv11 which is larger than Cv1 corresponding to the boundary position of the overlapping section. The magnitude of Cv11 and the rate of change at the time of shift from Cv0 to Cv11 are basically set by the manufacturer of the injection apparatus 1. That is, the magnitude of Cv11 and the rate of change at the time of shift from Cv0 to Cv11 are not based on the setting of the injection speed V by the operator, but are constant. However, sometimes the magnitude of Cv11 can be switched to either of two stages of magnitude according to the operation with respect to the input device 33. In the shown example, Cv11 is substantially equal to the command value corresponding to the low injection speed $V_L$.

FIG. 6B is a chart for explaining the problem which occurs under the control as described above. In this chart, a line Ln24 indicates the change along with time of the target value of the injection speed V set by the operator. A line Ln25 indicates the change along with time of the actual injection speed V.

As shown in this chart, in recent years, at the time of start of injection, sometimes the injection speed is set so that the injection speed is not made so as to smoothly reach the low injection speed $V_L$, but is made to reach the low injection speed $V_L$ (at the point t12) with a relatively moderate speed gradient. In such a case, in the same way as FIG. 6A, if the command value Cv is changed to Cv11 by the point t11, the actual speed becomes much larger than the target speed near the point t11. Next, the speed slowly falls, then the actual speed converges to the target speed. That is, the trackability of the actual speed with respect to the target speed is low.

As the reason for that, for example, there can be mentioned the following: The command value Cv11 at the point t11 is larger with respect to the target speed at the point t11. Even if the command value Cv is within a range not more than Cv1 (even if the spool 45 is positioned in the overlapping section), the flow rate of the hydraulic fluid is not 0. The actual speed sometimes also exceeds the target speed by this. Further, the proportional gain K (FIG. 3B) of the feedback control is set with reference to the time when the command value Cv exceeds Cv1 (time when the spool 45 has passed through the overlapping section). Accordingly, as in the region indicated by an arrow y3, when the command value Cv becomes lower than Cv1 (when the spool 45 is located in the overlapping section), compared with the amount of change of the flow rate with respect to the command value Cv, the proportional gain K is small, therefore the injection speed cannot be made to smoothly track the target value.

<Utilization of Open Control>

(Switching of Control Method)

Figure 6C:
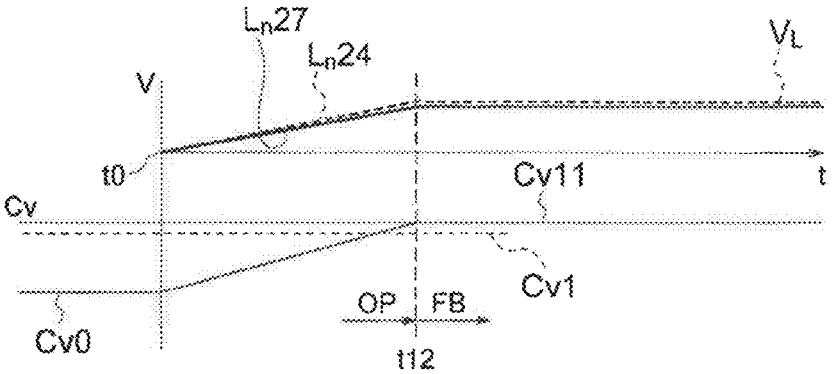

FIG. 6C is a chart for explaining in brief the control performed by the injection apparatus 1 according to the present embodiment in order to solve the problem described above and corresponds to FIG. 6A and FIG. 6B. A line Ln24, in the same way as the line Ln24 in FIG. 6B, indicates the change along with time of the target value of the injection speed V set by the operator. A line Ln27 indicates the change along with time of the actual injection speed V.

As described above, conventionally, irrespective of the target value of the injection speed V set through the input device 33 by the operator, at the time of start of injection, the flow control valve 29 was controlled so as to obtain a constant degree of opening by the spool 45 passing through the overlapping section OR in a relatively short time determined in advance.

On the other hand, in the present embodiment, at the time of start of injection, the control device 11 performs open control in accordance with the target value of the injection speed V which was set through the input device 33 by the operator. After that, it performs feedback control. In this open control, the flow rate characteristic of the flow control valve 29 at the time when the spool 45 is positioned in the overlapping section is also considered. In other words, in this open control, the change along with time of the command value corresponding to the movement of the spool 45 in the overlapping section changes in accordance with the target speed set by the operator. Due to this, for example, even in a case where the set target speed is one reaching the low injection speed $V_L$ with a relatively moderate speed gradient after the start of injection, the actual speed suitably tracks the target speed.

For example, in a case where the target speed set by the operator reaches the low injection speed $V_L$ at the point t12 and then the low injection speed $V_L$ is held for a certain degree of period (for example a period until the start of the high speed injection), the control device 11 performs open control up to the point t12, then performs feedback control. The command value Cv in the range from the point t0 to the point t12 is set by specifying the command value Cv in accordance with the target speed with reference to the information of correspondence between the command values Cv and the speeds V as shown in FIG. 5.

Figure 7:
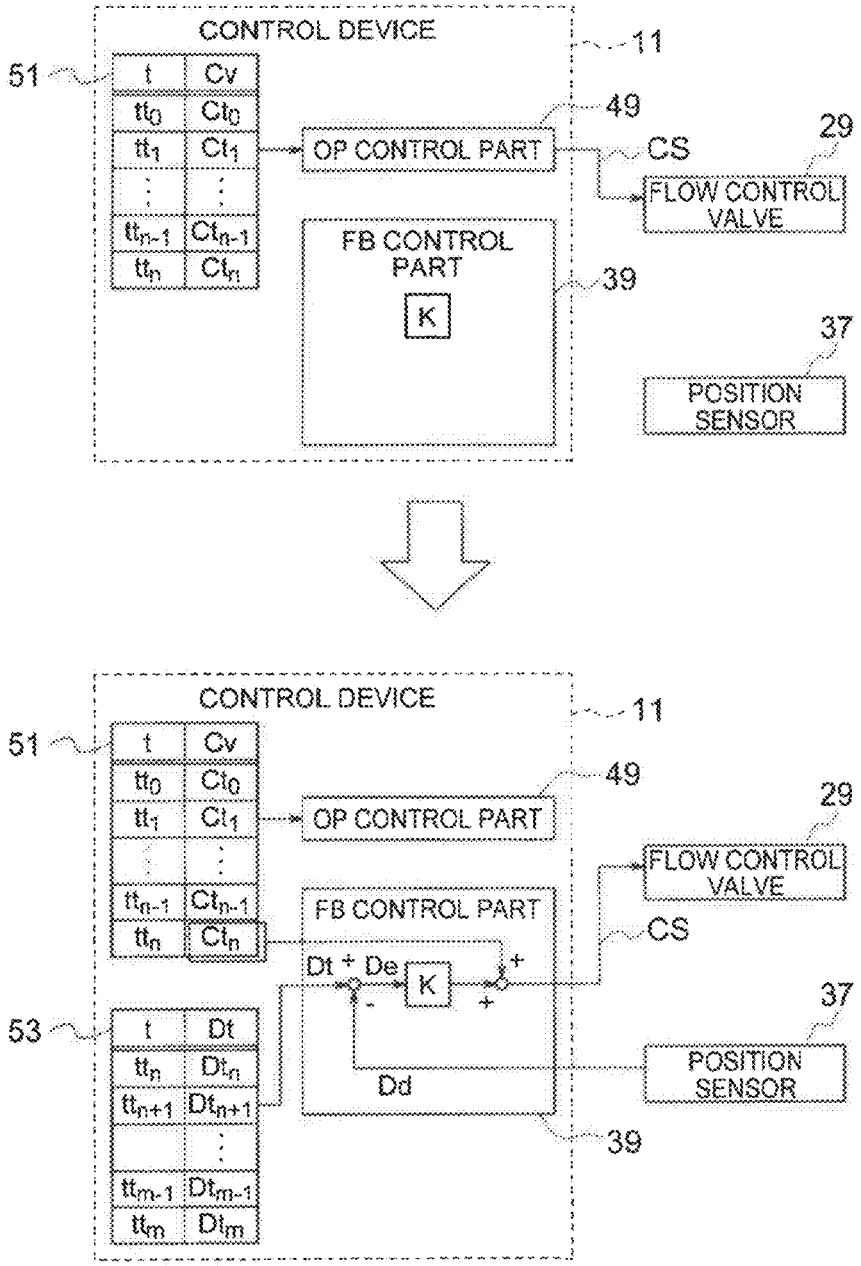
FIG. 7 A schematic view for explaining an operation of switching a control system in the injection apparatus in FIG. 1.

FIG. 7 is a schematic view showing the change of operation of the control device 11 at the time of shift from open control to feedback control. The view on the upper side on the page corresponds to the state where the open control is carried out at the time of start of injection, while the view on the lower side on the page corresponds to the state where the feedback control is carried out continuing from the open control.

As shown on the upper side on the page in FIG. 7, the control device 11 has an OP control part 49 for performing open control of the flow control valve 29 in addition to the FB control part 39 explained with reference to FIG. 3B. Further, the control device 11 generates an OP control-use table 51 as information for prescribing the command value Cv for each elapse of time and holds it in the RAM etc.

The OP control-use table 51 for example holds points $tt_0$ to $tt_n$ for each predetermined time increment and the command values $Ct_0$ to $Ct_n$ corresponding to the target speed at each point of time linked together. The OP control-use table 51, as explained above, is generated by specifying the command value Cv corresponding to the target speed for each elapse of time with reference to the information of the flow rate characteristic of the flow control valve 29 as shown in FIG. 5.

Further, the OP control part 49 outputs the control command CS of the command value Cv set for each elapse of time in order to the flow control valve 29 with reference to the OP control-use table 51. Note that, even in this open control, naturally minor loop feedback control by the servo driver 41 may be carried out.

Note that, in the same way as FIG. 3A, the control start point $tt_0$ corresponds to the point t0 of the start of injection in FIG. 6C. The command value $Ct_0$ corresponds to the command value Cv0 (speed 0) in FIG. 6C. Note that, the data at the time of point $tt_0$ (t0) (data corresponding to the speed 0) is actually unnecessary for the OP control-use table 51.

The point $tt_n$ of the end of control corresponds to the point t12 at which the injection speed becomes constant (low injection speed $V_L$) in FIG. 6C. The command value $Ct_n$ corresponds to the command value Cv11 in FIG. 6C (low injection speed $V_L$). Note that, the point $tt_n$ may be also a point of time immediately before or immediately after the point t12 by the amount of one time increment from the point $tt_0$ to the point $tt_n$. This case is also included in the case where open control is carried out until the point t12.

The time increment (time increment from point $tt_0$ to point $tt_n$ in the OP control-use table 51) by which the OP control part 49 changes the command value Cv is for example constant throughout the open control. Further, the time increment may be the same as the time increment of the feedback control or may be different. The span of the time increment may be suitably set, but is for example about 1 ms.

In generation of the OP control-use table 51 and control according to the OP control part 49, it is not particularly necessary to perform judgment for distinguishing between the inside/outside of the overlapping section OR and so on. The command value Cv changes along with time in accordance with the target speed set by the operator even in a range where the spool 45 is positioned in the overlapping section OR (range from command value Cv0 to Cv1 in FIG. 5) since the time increment from the point $tt_0$ to the point $tt_n$ is relatively short, the speed near the time of start of injection (for example low injection speed $V_L$) is relatively low, and the information including the flow rate characteristic of the overlapping section OR as shown in FIG. 5 is referred to.

When the OP control part 49 ends the control until the point $tt_n$, as shown on the lower side on the page in FIG. 7, in place of the OP control part 49, the FB control part 39 outputs the control command CS to the flow control valve 29. An outline of that operation is as explained with reference to FIG. 3B.

As explained with reference to FIG. 3A, the control device 11 can generate the target position table Tb2. In this, the information from the point $tt_n$ of the ending point of time of open control ($tt_{n+1}$ according to a concrete control method) is held in the RAM etc. as the information for feedback control. That is, the control device 11 holds the FB control-use table 53 linking the points $tt_n$ to $tt_m$ of the predetermined time increments and the target positions $Dt_n$ to $Dt_m$ at the points of time. Further, the FB control part 39, as explained with reference to FIG. 3, specifies the target position Dt at the point of time for each elapse of time and multiplies the deviation De by the proportional gain to set the command value Cv.

The FB control part 39 may fetch as offset the command value Cv (command value $Ct_n$ in the OP control-use table 51) of the control command CS output by the OP control part 49 when shifting from open control to feedback control. That is, the command value $Ct_n$ is added to the command value obtained by multiplying the deviation De by the proportional gain K to obtain the final command value Cv. Due to this, for example, it becomes easy to eliminate steady-state deviation.

(Generation of Characteristic Data of Flow Control Valve)

As explained above, in the generation of the OP control-use table 51, the information of the flow rate characteristic of the flow control valve 29 as shown in FIG. 5 is referred to. This flow rate characteristic varies not only among different types of products, but also among the same type of products (same designed value). As the factors thereof, there can be mentioned error in dimensions when preparing flow control valves 29, a difference of sizes of die-cast machines DC1 provided with the flow control valves 29, and so on. Further, even in one flow control valve 29, the flow rate characteristic thereof changes along with time due to wear etc. Therefore, the injection apparatus 1 measures the flow rate characteristics at a suitable timing and updates (generates at first) the information of the flow rate characteristic.

(Specialized Operation for Updating Information)

Figure 8:
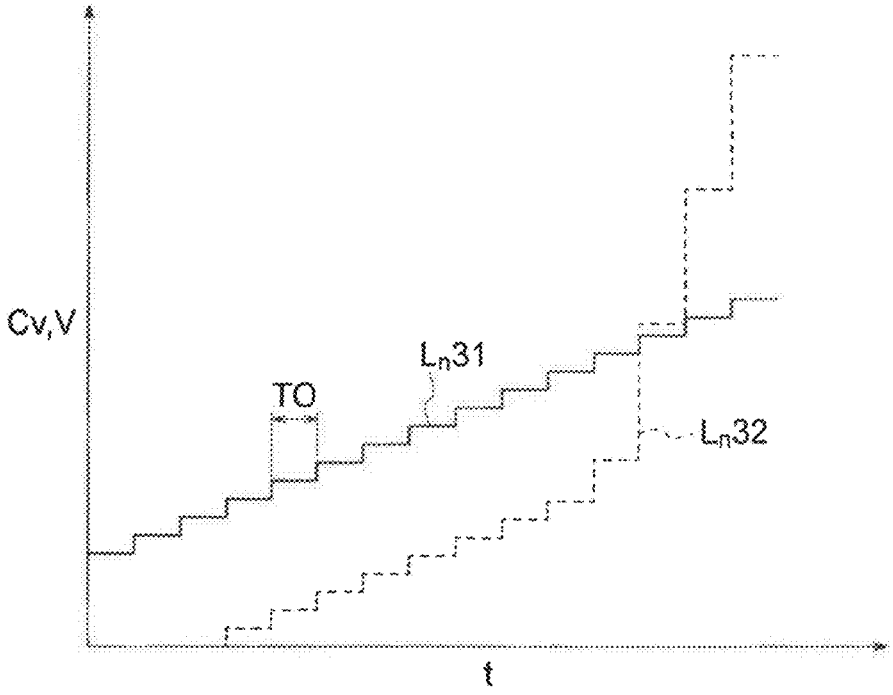
FIG. 8 A schematic view for explaining an example of an operation at the time when the injection apparatus in FIG. 1 measures the flow rate characteristics.

FIG. 8 is a schematic view for explaining an example of the operation when measuring the flow rate characteristic by the injection apparatus 1.

In this graph, the abscissa indicates the time t, and the ordinate indicates the command value Cv and the speed V of the plunger 5. A line Ln31 indicates the change along with time of the command value Cv, while a line Ln32 indicates the change along with time of the speed V of the plunger 5.

The speed V of the plunger 5 indicated by the line Ln32 is the measurement value at the time when the control command CS of the command value Cv indicated by the line Ln31 is output to the flow control valve 29. The speed V is for example measured by the position sensor 37. The operation shown in this graph is carried out separately from the molding cycle. Further, this operation is for example carried out in a so-called blank shooting state where the molten metal is not supplied to the sleeve 3.

The control device 11, for example, as indicated by the line Ln31, sequentially outputs the control commands CS for a plurality of command values Cv. Further, the control device 11 for example outputs the control command CS throughout the predetermined duration TO for each command value Cv. Further, the control device 11 detects the speed V of the plunger 5 at the time when the control command CS of each command value Cv is output. Due to this, the control device 11 can specify the speed V of the plunger 5 corresponding to the command value Cv, consequently the information of the flow rate characteristics as shown in FIG. 5 is generated.

Note that, the control commands CS for various command values Cv may be output in an order whereby the command value Cv gradually becomes larger as in the shown example (the flow rate gradually becomes larger). Conversely, they may be output in an order whereby the command value Cv becomes smaller or at random. The span of the time TO and the amount of change when changing the command value Cv are for example constant with respect to various command values Cv. Further, concrete values thereof may be suitably set. The range of command value Cv which becomes the measurement target is set large enough to generate the OP control-use table 51 and includes at least a range of command value Cv applicable until the spool 45 passes through the overlapping section OR from the reference position (FIG. 4A). Note that, these measurement-use parameters are basically set by the manufacturer of the injection apparatus 1. However, they may also be set through the input device 33 by the operator. As the speed V in each time TO, for example, a mean value of speed V measured during that time period TO may be used.

The above operation may be automatically carried out by the control device 11 when predetermined conditions are satisfied (for example when the predetermined timing comes) or may be carried out when a predetermined operation is carried out by the operator. Further, the timing for performing the above operation may be suitably selected. For example, it may be the first time of start of operation after shipment of die-cast machine, the time of start of daily operation, the time when negative judgment is carried out by the quality judgment (explained later) for the control result, or any timing set by the operator.

(Updating of Information Based on Injection Operation)

In the above description, an aspect was explained where a specialized operation for measuring the flow rate characteristic of the flow control valve 29 was performed separately from the injection operation (molding cycle). Together with, or in place of updating the information of the flow rate characteristic based on this specialized operation, the information of the flow rate characteristic may be updated based on the injection operation as well.

Figure 9:
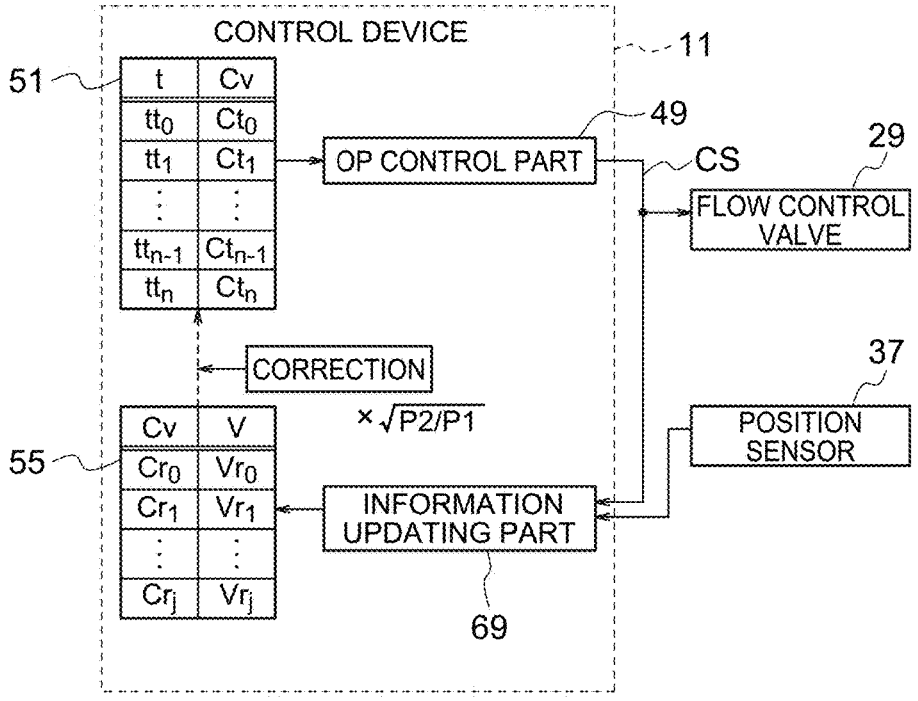
FIG. 9 A schematic view for explaining an example of an operation of updating the flow rate characteristics by the injection apparatus in FIG. 1.

FIG. 9 is a schematic view showing the configuration of the injection apparatus 1 in an aspect where the information of flow rate characteristics of the flow control valve 29 is updated based on the injection operation.

In this view, the characteristic table 55 is data holding information concerning the flow rate characteristic of the flow control valve 29 and holds the command values Cv ($Cr_0$ to $Cr_j$) and the speeds V ($Vr_0$ to $Vr_j$) of the plunger 5 when the command value Cv is output linked together. Further, the OP control-use table 51 is set with reference to the characteristic table 55 so that the injection speed set by the operator is realized.

As explained with reference to FIG. 7, the OP control part 49, in the injection operation, sequentially outputs the control command CS of command value Cv set for each elapse of time to the flow control valve 29 with reference to the OP control-use table 51. At this time, the information updating part 69 in the control device 11 acquires the command value Cv of that control command CS and the speed detected by the position sensor 37 and links the command value Cv and the speed at the same point of time (or the speed at the point of time which is bit later with respect to the command value Cv). Due to this, generation or updating of the characteristic table 55 becomes possible.

Specifically, for example, the information updating part 69 suitably interpolates and/or extrapolates two or more sets of command value Cv and data of detection speed acquired during the open control to calculate the speed corresponding to the command value Cv held in the characteristic table 55 and updates the value of the speed V held in the characteristic table 55 according to that calculated speed. Otherwise, the information updating part 69 may update the value of the speed V in the characteristic table 55 including also the command value Cv held in the characteristic table 55 according to the two or more sets of command value Cv and data of detection speed which are acquired.

The characteristic table 55 may be updated based on the injection operation for each cycle or only at the time when predetermined conditions are satisfied. The predetermined conditions are for example that a specific operation is carried out with respect to the input device 33 by the operator, that a predetermined number of cycles is executed, and that the difference dD (FIG. 11) which will be explained later exceeds the predetermined value. Information which is necessary for updating the characteristic table 55 may be collected for each cycle, and the characteristic table 55 may be updated only at the time when the predetermined conditions are satisfied (for example only at the time of judgment as "good" in the quality judgment which will be explained later).

(Correction of Information of Flow Rate Characteristic)

As shown in FIG. 9, the characteristic table 55 may be corrected as well during the time period until setting of the OP control-use table 51 by referring to the characteristic table 55.

For example, assume that the change along with time of the speed V indicated by the line Ln13 in FIG. 5 is obtained by supplying the hydraulic fluid from the accumulator 23 built up to the predetermined pressure to the head-side chamber 13*h* and driving the plunger 5. Ideally, even if the molding cycle is repeated, the predetermined pressure described before is constant.

In actuality, however, for example, sometimes the predetermined pressure gradually becomes lower due to repetition of the molding cycle and/or the predetermined pressure fluctuates between the molding cycles due to variation of control of the pump 21 for storage of pressure of the accumulator 23 and so on. As a result, in FIG. 5, the characteristic indicated by the line Ln13 ends up changing to the characteristic as indicated by the line Ln14. Note that, FIG. 5 exemplifies a case where the predetermined pressure becomes lower than that when the characteristic of the line Ln13 is obtained and the speed V with respect to the command value Cv falls.

Therefore, for example, immediately before opening of the in-side valve 28 or immediately before the start of the open control of the flow control valve 29 (below, they will be sometimes referred to as "immediately before injection"), the characteristic table 55 is corrected based on the change of the detection value of the ACC-use pressure sensor 34 immediately before the injection. The correction is for example carried out for each cycle.

Specifically, for example, in a case where the current (present cycle) ACC pressure (detection value of ACC-use pressure sensor 34 immediately before injection) falls relative to the ACC pressure (reference pressure) when the characteristic table 55 was obtained (generated or updated), the value of the speed V linked with the command value Cv is lowered. Conversely, if the current ACC pressure rises relative to the ACC pressure at the time when the characteristic table 55 was obtained, the value of the speed V linked with the command value Cv is raised.

The OP control-use table 51 is set by referring to the characteristic table 55. Therefore, the command value Cv in the OP control-use table 51 is substantially corrected by the correction of the characteristic table 55. Specifically, for example, when the detection value of the ACC-use pressure sensor 34 immediately before injection is smaller (or larger) than the ACC pressure (reference pressure) at the time when the characteristic table 55 was obtained, the command value Cv is substantially corrected so that the degree of opening of the flow control valve 29 becomes larger (or smaller) than that at the time when the detection value is equal to the reference pressure described before.

The more concrete correction method may be made a suitable one. From another viewpoint, the degree of correction with respect to the degree of change of ACC pressure may be suitably set. For example, if the ACC pressure when the characteristic table 55 is obtained is P1 and the ACC pressure immediately before injection is P2, it is possible to multiply $\sqrt{(P2/P1)}$ with the value of the speed V in the characteristic table 55 and define this as the value of the speed V after correction. That is, the root value (square root) of the ratio of ACC pressure may be multiplied with the speed V. This correction is based on Bernoulli's principle.

Note that, in the above description, the "ACC pressure when the characteristic table 55 is obtained", as understood from the already described explanation, may be for example the ACC pressure when a measurement-use operation (FIG. 8) which is different from the molding cycle is carried out (more specifically, for example the detection value of the ACC-use pressure sensor 34 immediately before the start of the measurement-use operation) or may be the ACC pressure (detection value of the ACC-use pressure sensor 34 immediately before injection) of the molding cycle (FIG. 9) when the characteristic table 55 is obtained.

The characteristic table 55 after correction and ACC pressure (P2) immediately before injection which was utilized for correction may be temporarily held for use only in the current molding cycle or may be held so that they can be utilized even in the following molding cycle. In a case where they are utilized even in the following molding cycle, for example, the characteristic table 55 after the correction and the ACC pressure (P2) become the characteristic table 55 for correction and the reference pressure (P1) at the time when the correction of the characteristic table is carried out next (for example in the next molding cycle). Note that, in a case where the characteristic table 55 is updated based on the operation of the molding cycle explained with reference to FIG. 9 for each cycle, the characteristic table 55 after correction is basically used only in that cycle.

(Timing of Start of Driving Flow Control Valve)

Figure 10:
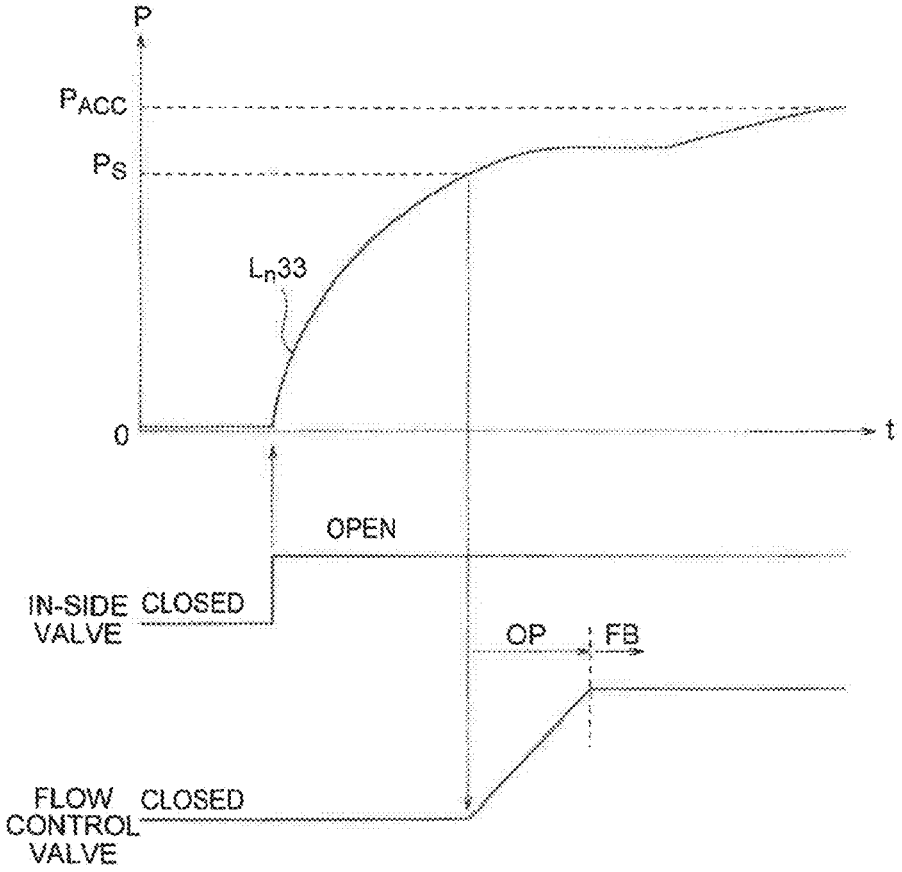
FIG. 10 A timing chart for explaining a timing for opening the flow control valve.

FIG. 10 is a chart for explaining the timing (start of open control) for starting the drive of the flow control valve 29 to the opening direction at the time of start of injection.

In this chart, the abscissa "t" indicates the time. In the upper stage of the chart, the ordinate indicates the pressure P, and a line Ln33 indicates the change along with time of the pressure of the head-side chamber 13*h* (detection value of the head-use pressure sensor 36). The lower stage thereof becomes the timing chart showing the driving state of the in-side valve 28 and flow control valve 29.

Immediately before the start of injection, the in-side valve 28 and the flow control valve 29 are closed. At the time of start of injection, first, the in-side valve 28 is opened. Due to this, the hydraulic fluid is supplied from the accumulator 23 to the head-side chamber 13*h*. Note that, if the compression of the hydraulic fluid is ignored, only the liquid pressure is given from the accumulator 23 to the head-side chamber 13*h* and the hydraulic fluid does not flow. However, even such a state is expressed as the "supply of hydraulic fluid".

By the start of the supply of the hydraulic fluid from the accumulator 23 to the head-side chamber 13*h*, the head pressure rises. Specifically, the head pressure approaches the pressure of the accumulator 23 (ACC pressure $P_{ACC}$). Note that the drop in the ACC pressure in the initial stage of injection is relatively small. Here, the ACC pressure $P_{ACC}$ is shown as being constant.

Further, when the detection value of the head-use pressure sensor 36 reaches the predetermined set value $P_S$, the open control of the flow control valve 29 is started. Due to this, for example, the head pressure at the time when the open control is carried out approaches the head pressure when the characteristic table 55 is obtained and/or the influence of the transient characteristic of the head pressure exerted upon the open control is reduced.

The set value $P_S$ may be suitably set in a range less than the ACC pressure $P_{ACC}$, may be set by the manufacturer of the injection apparatus 1, may be set by the operator, or may be automatically set based on various casting conditions by the control device 11.

(Judgment of Quality of Results of Control)

Figure 11:
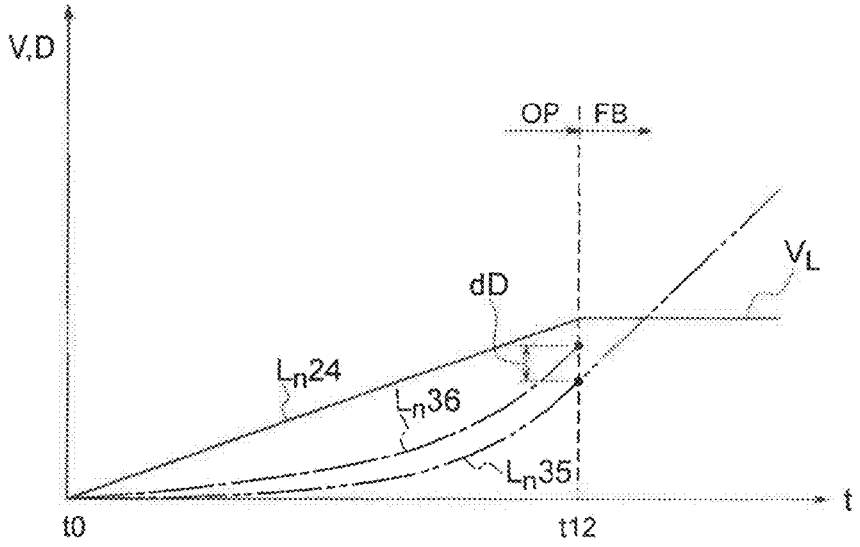
FIG. 11 A graph for explaining a quality judgment method for control results according to an open control.

FIG. 11 is a graph for explaining the method of judgment of the quality of the results of control according to the open control.

In this graph, the abscissa indicates the time "t". The ordinate indicates the speed V of the plunger 5 and the position D of the plunger 5. As understood from notations of the points t0 and t12 and low injection speed $V_L$, this graph indicates the change along with time at the time of start of injection where the injection speed shown in FIG. 6C is set.

The line Ln24, in the same way as FIG. 6C, indicates the change along with time of the target speed V. The line Ln35 indicates the change along with time of the target position D found from the target speed V. The line Ln36 indicates the change along with time of the actual position D of the plunger 5 (detection value by the position sensor 37).

Ideally, the line Ln36 indicating the detection position by the position sensor 37 coincides with the line Ln35 indicating the target position. However, for example, if the flow rate characteristic changes due to the change along with time of the flow control valve 29 or some abnormality arises in the injection apparatus 1, as in the shown example, the line Ln36 no longer coincides with the line Ln35.

Therefore, the control device 11 for example calculates the difference dD between the target position and the detection position at the time when the open control ends (may be before or after the end by about the amount of one time increment of open control) and judges the quality of the control according to whether this difference dD is within the predetermined permissible range (whether it exceeds the threshold value). Further, the control device 11, when judging that the difference exceeds the threshold value, for example, makes the display device 35 display a predetermined alert image. Due to this, for example, the operator can learn that the timing of updating the information of the flow rate characteristic has arrived or learn that some abnormality has occurred in the injection apparatus 1. The alert image is for example an image which displays a predetermined text and/or predetermined graphic to inform the viewer that the difference dD exceeds the threshold value or prompt updating of the information of the flow rate characteristic (for example execution of a specialized operation for measurement explained with reference to FIG. 8).

(Block Diagram and Flow Chart)

Figure 12:
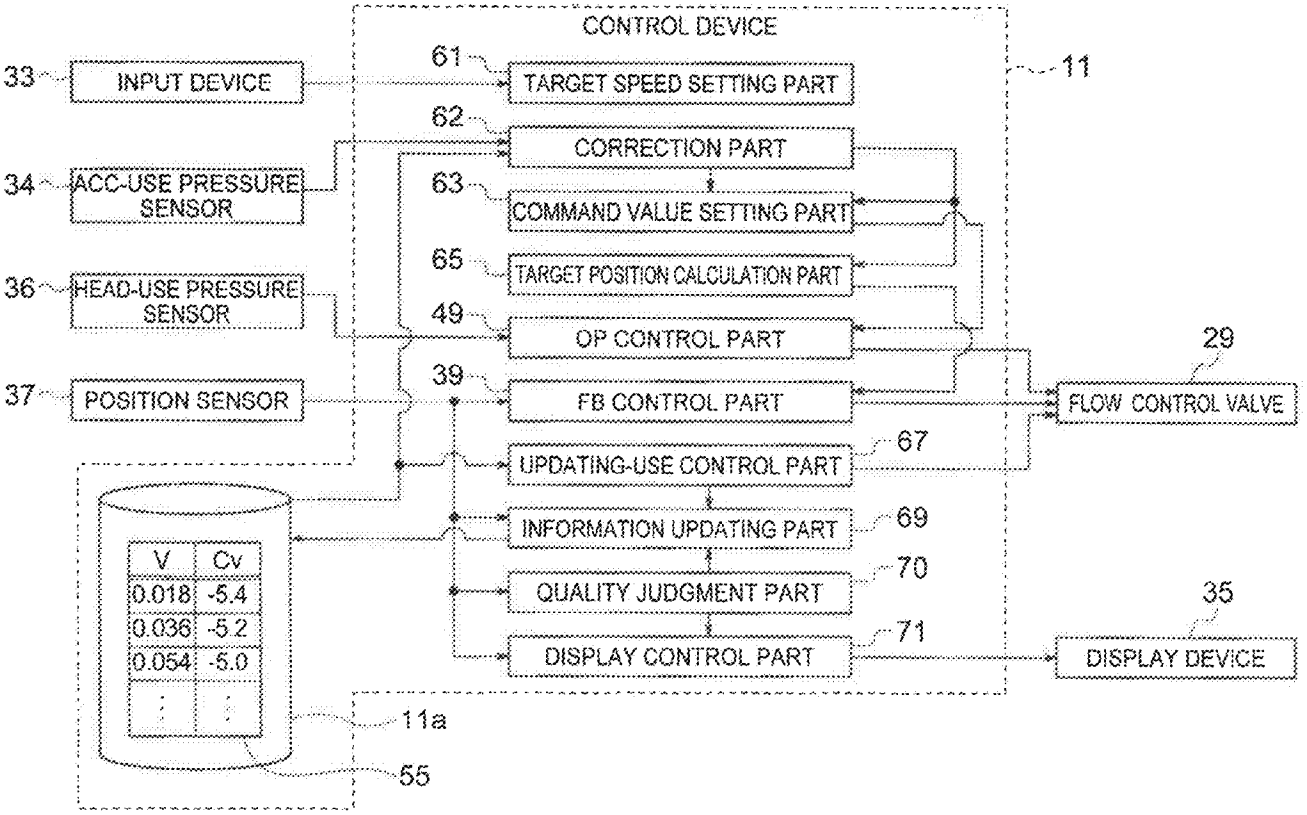
FIG. 12 A block diagram showing the configuration of a signal processing system in the injection apparatus in FIG. 1.

FIG. 12 is a block diagram conceptually showing the configuration of the signal processing system for realizing injection control utilizing the open control as described above.

The control device 11 holds the characteristic table 55 in the storage part 11*a*. The storage part 11*a* is for example an external storage device or a RAM. In the control device 11, by execution of the program stored in ROM and/or external storage device by the CPU, various types of functional parts (39, 49, 61, 62, 63, 65, 67, 69, 70, and 71) are configured. The operations of the various functional parts are for example as follows.

The target speed setting part 61 sets the target speed based on a signal from the input device 33 in accordance with an operation by the operator. For example, the target speed setting part 61 generates the target speed table Tb1 shown in FIG. 3A.

The correction part 62 corrects the characteristic table 55 held in the storage part 11*a* based on the detection value of the ACC-use pressure sensor 34 immediately before injection and the reference pressure (ACC pressure when the characteristic table 55 is obtained).

The command value setting part 63 sets the command value for each elapse of time for the open control based on the target speed table Tb1 set by the target speed setting part 61 and the characteristic table 55 after correction. For example, the command value setting part 63 generates the OP control-use table 51 shown in FIG. 7.

The target position calculation part 65 calculates the target position for each elapse of time for the feedback control based on the target speed table Tb1 generated by the target speed setting part 61. For example, the target position calculation part 65 generates the FB control-use table 53 shown in FIG. 7.

Note that, as will be understood also from the explanation of the flow chart which will be explained later, the command value setting part 63 also utilizes the target position table Tb2 shown in FIG. 3A. The target position calculation part 65 may also be used for the generation of this target position table Tb2.

The OP control part 49 is as explained with reference to FIG. 7. Further, the FB control part 39 is as explained with reference to FIG. 3B and FIG. 7.

The updating-use control part 67 performs the operation explained with reference to FIG. 8. That is, the control command CS is output to the flow control valve 29 so that the change along with time of the command value Cv indicated by the line Ln31 in FIG. 8 is realized. Here, for example, in a mode where the command value Cv in the characteristic table 55 is fixed and only the value of the speed V is updated, the updating-use control part 67 may refer to the characteristic table 55 and use the command value Cv held in the characteristic table 55 as the command value Cv of the control command CS to be output.

The information updating part 69, for example, at the time when the updating-use control part 67 outputs the control command CS of the command value Cv indicated by the line Ln31 in FIG. 8, acquires that command value Cv and the value of the speed V of the plunger 5 detected by the position sensor 37. Otherwise, the information updating part 69, as explained with reference to FIG. 9, acquires the command value Cv of the control command CS output by the OP control part 49 and the value of the speed V of the plunger 5 detected by the position sensor 37 in the injection operation. Further, the information updating part 69 updates the characteristic table 55 based on the acquired command value Cv and the value of the speed V.

The quality judgment part 70, based on the target position set by the target speed setting part 61 and the position detected by the position sensor 37, performs the quality judgment explained with reference to FIG. 11. That is, the quality judgment part 70 judges whether the difference dD between the target position and the detection position at the time of the end of the open control exceeds the predetermined threshold value.

The display control part 71 outputs the control command to the display device 35 so as to display the predetermined alert when it is judged by the quality judgment part 70 that the difference dD exceeds the threshold value.

Figure 13:
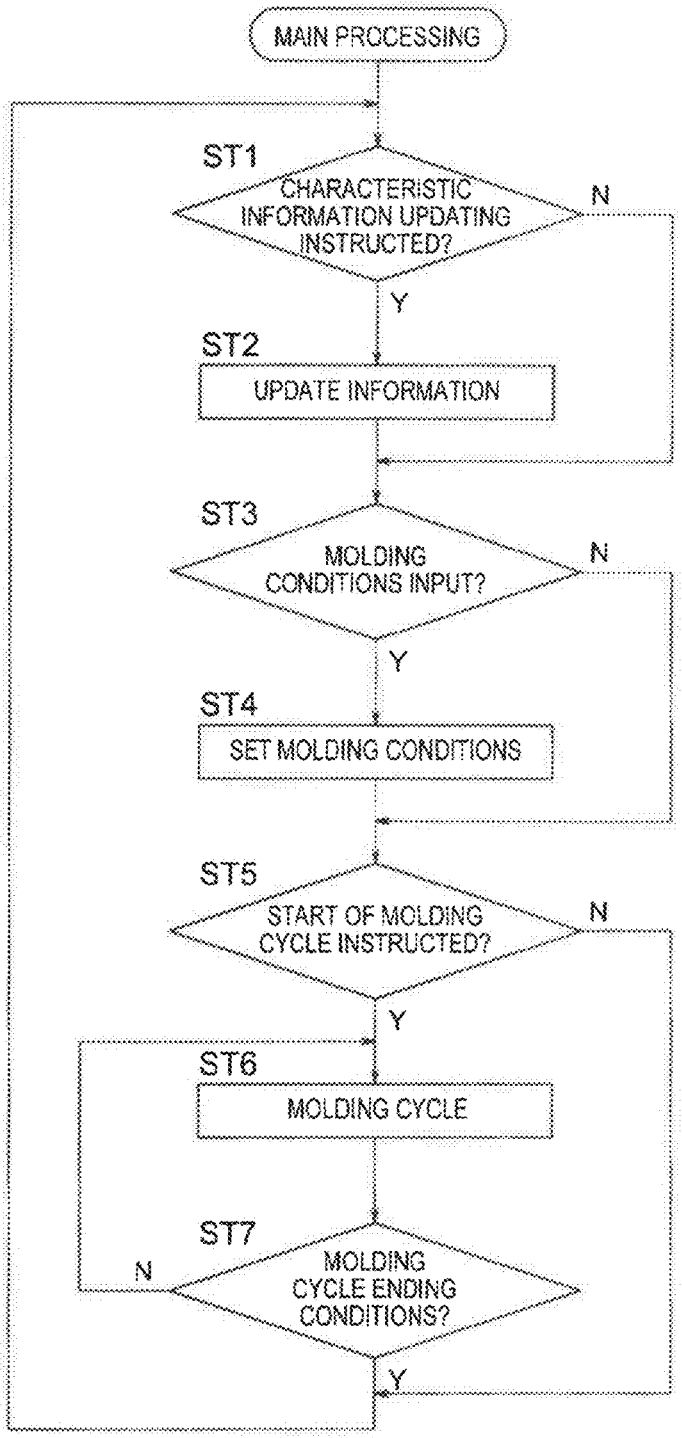
FIG. 13 A flow chart showing an example of the routine of main processing executed by a control device in the injection apparatus in FIG. 1.

FIG. 13 is a flow chart showing an example of the routine of main processing executed by the control device 11 in order to realize injection control utilizing open control. This processing is for example started when the power of the control device 11 is turned on.

At step ST1, the control device 11 judges whether an operation instructing updating of the characteristic table 55 was carried out with respect to the input device 33. Further, the control device 11 proceeds to step ST2 when judging yes while skips step ST2 when judging no.

At step ST2, the control device 11, as explained with reference to FIG. 8, performs the specialized operation for measuring the flow rate characteristic which is different from the molding cycle and updates the characteristic table 55. That is, the control device 11 sequentially outputs the control commands CS of various command values Cv to the flow control valve 29, measures the speeds V at that time, and updates the values of the speeds V in the characteristic table 55 based on the measurement results.

In this way, in the shown example, the characteristic table 55 is updated in accordance with an operation with respect to the input device 33 by the operator. However, as already alluded to, in addition to or in place of the operation by the operator, the control device 11 may automatically update the characteristic table 55 as well at the time when a predetermined condition is satisfied. The predetermined condition is for example that the present time is immediately after turning on the power of the die-cast machine DC1 or that the control result is judged to be bad at step ST31 as will be explained later.

At step ST3, the control device 11 judges whether an operation for setting the molding conditions has been carried out with respect to the input device 33. Further, the control device 11 proceeds to step ST4 when judging yes while skips step ST4 when judging no. Note that, the molding conditions are for example the injection speed and casting pressure.

At step ST4, the control device 11 sets the molding conditions based on the information input according to an operation with respect to the input device 33.

At step ST5, the control device 11 judges whether an operation for starting the molding cycle has been carried out with respect to the input device 33. Further, the control device 11 proceeds to step ST6 when judging yes while skips steps ST6 and ST7 when judging no.

At step ST6, the control device 11 outputs a control command so that the molding cycle is carried out one time under the molding conditions set at step ST4. Due to this, for example, clamping by the clamping device, injection by the injection apparatus 1, opening by the clamping device, ejection of the molded article by the ejection device, and so on are carried out.

At step ST7, the control device 11 judges whether the condition for ending the repetition of the molding cycle is satisfied. For example, the control device 11 judges whether step ST6 has been repeated for the number of cycles set at step ST4. Further, the control device 11 proceeds to the next step (returns to step ST1 in the shown example) when judging yes, while returns to step ST6 and repeats the molding cycle when judging no.

Figure 14:
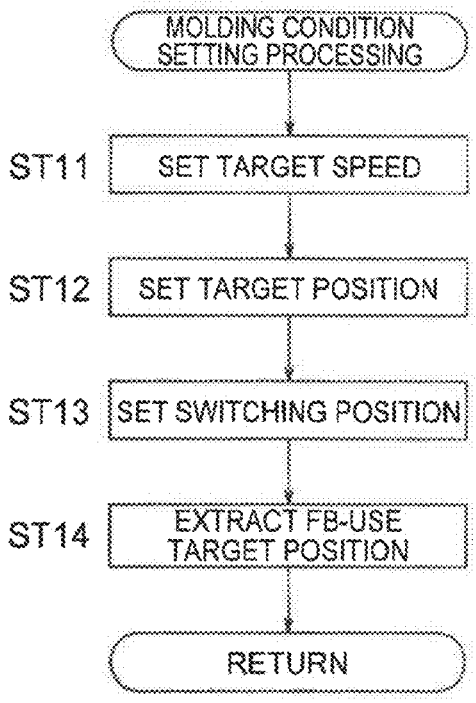
FIG. 14 A flow chart showing an example of molding condition setting processing executed at step ST4 in FIG. 13.

FIG. 14 is a flow chart showing an example of the molding condition setting processing executed by the control device 11 at step ST4 in FIG. 13. However, this chart illustrates only the procedure for setting the injection speed in the procedure for setting the molding conditions.

At step ST11, the control device 11 generates the target speed table Tb1 shown in FIG. 3A based on a signal from the input device 33.

At step ST12, the control device 11 generates the target position table Tb2 based on the target speed table Tb1 as explained with reference to FIG. 3A.

At step ST13, the control device 11 sets the position of the plunger 5 at which open control is switched to feedback control. For example, the control device 11, based on the target speed table Tb1, specifies the position at which the speed is made constant first at the time of start of injection (usually the low injection speed $V_L$) and makes this position the position at which switching is to be carried out. Note that, it is also possible for the operator to designate the switching position through the input device 33 for the plurality of positions D held in the target speed table Tb1 or separately from the position D in the target speed table Tb1.

At step ST14, the control device 11 compares the switching position set at step ST13 and the target position Dt in the target position table Tb2 generated at step ST12 and extracts the data after the switching position from the target position table Tb2. Due to this, the FB control-use table 53 shown in FIG. 7 is generated.

Figure 15:
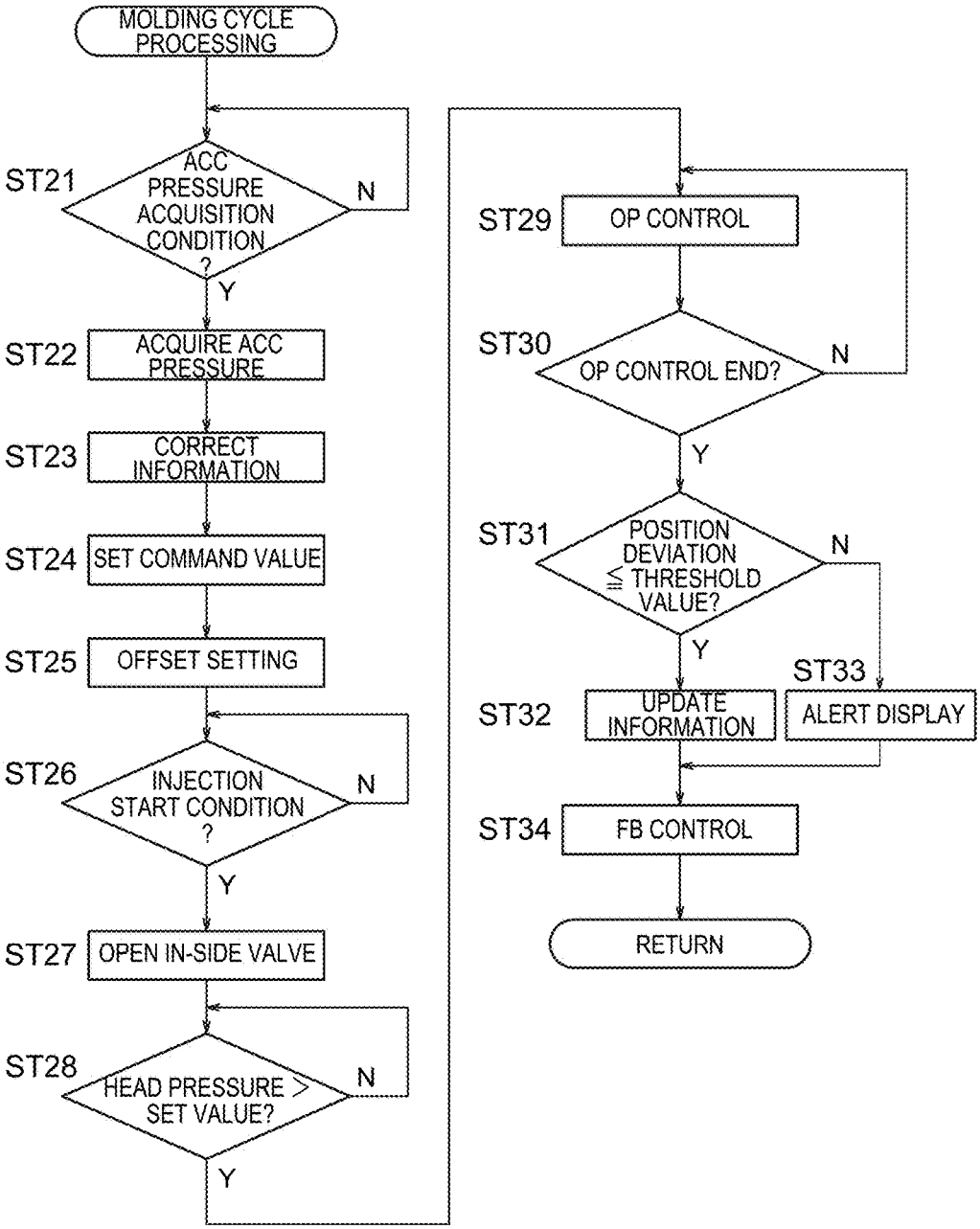
FIG. 15 A flow chart showing an example of molding condition setting processing executed at step ST6 in FIG. 13.

FIG. 15 is a flow chart showing an example of the molding cycle processing executed by the control device 11 at step ST6 in FIG. 13. Note, this chart shows only the procedure relating to the speed control in the procedure of the molding cycle processing.

At step ST21, the control device 11 judges whether the ACC pressure acquisition condition is satisfied. That is, the control device 11 judges whether the timing at which the ACC pressure immediately before injection, utilized for the correction of the characteristic table 55 explained with reference to FIG. 5 and FIG. 9, must be detected has arrived. The ACC pressure acquisition condition is for example that the accumulator 23 has finished being filled. From another viewpoint, the condition is that the state where the ACC pressure basically does not fluctuate until the in-side valve 28 is opened at step ST27 explained later is manifested. Further, the control device 11 proceeds to step ST22 when judging yes while stands by when judging no.

At step ST22, the control device 11 acquires the ACC pressure. That is, the control device 11 acquires the detection value of the ACC-use pressure sensor 34 as the ACC pressure immediately before injection.

At step ST23, the control device 11, as explained with reference to FIG. 5 and FIG. 9, corrects the characteristic table 55 based on the comparison between the detection value of the ACC pressure and the ACC pressure (reference pressure) at the time when the characteristic table 55 stored in the storage part 11*a* is obtained. Note that, the characteristic table 55 after the correction, as understood from the already described explanation, may be stored in the storage part 11*a* in place of the characteristic table 55 before the correction or may be stored in the storage part 11*a* separately from the characteristic table 55 before the correction for use.

At step ST24, the control device 11 generates the OP control-use table 51 shown in FIG. 7. Specifically, for example, first, the control device 11 compares the target position Dt in the target position table Tb2 generated at step ST12 and the switching position set at step ST13 and extracts the data corresponding to the range from the injection start position to the switching position (range of performing the open control) from the target position table Tb2. Further, the control device 11 specifies target speeds corresponding to the plurality of target positions Dt of the extracted data based on the target speed table Tb1. Due to this, the elapsed time of the data extracted from the target position table Tb2 and the target speeds prescribed in the target speed table Tb1 are linked and consequently a table of the target speed with respect to the elapsed time can be generated.

The method when specifying the target speeds corresponding to the plurality of target positions Dt of the data extracted from the target position table Tb2 based on the target speed table Tb1 may be a suitable one. For example, as explained in the method of converting the target speed table Tb1 to the target position table Tb2, interpolated data of the target speed table Tb1 is generated, the target speed of the interpolated data is multiplied by the predetermined time increment, and the result is sequentially integrated. Further, the target speed at time when that integrated value (target position) reaches (exceeds) the target position Dt of the table extracted from the target position table Tb2 described above may be defined as the target speed corresponding to the target position Dt. Naturally it may be found from an equation as well.

After that, the control device 11, based on the characteristic table 55 corrected at step ST23, specifies the command value corresponding to the target speed in the table linking the above elapsed time and the target speed. For example, in a case where the target speed Vt is the value between the speeds Vd1 and Vd2 held in the characteristic table 55 and the command values linked with the speeds Vd1 and Vd2 are Cvd1 and Cvd2, the command value Cv corresponding to the target speed Vt may be found according to $Cv=Cd1+(Cd2-Cd1)\times(Vt-Vd1)/(Vd2-Vd1)$ (It may be found from two data before and after the target speed Vt.). Naturally, it is also possible to find an approximation for approximating the plurality of data in the characteristic table 55 and enter the target speed into this approximation to calculate the command value. However, in this case, preferably the approximation is made different between the overlapping section OR and the outside thereof. The command value of the boundary for separating the approximation is for example set in advance by the manufacturer.

At step ST25, as explained with reference to FIG. 7, among the command values for open control set at step ST24, the control device 11 sets the last command value in the open control as the offset of the feedback control.

At step ST26, the control device 11 judges whether the predetermined injection start conditions are satisfied. Further, the control device 11 proceeds to step ST27 when judging yes, while stands by when judging no. The injection start conditions are for example completion of the supply of the molten metal to the sleeve 3 by a not shown molten metal supply device and so on.

At step ST27, the control device 11 outputs the control signal for opening the in-side valve 28. Due to this, the in-side valve 28 is opened, and the liquid pressure is given from the accumulator 23 to the head-side chamber 13*h*. Consequently, as explained with reference to FIG. 10, the pressure of the head-side chamber 13*h* rises.

At step ST28, the control device 11, as explained with reference to FIG. 10, judges whether the detection value detected by the head-use pressure sensor 36 has reached the predetermined set value $P_S$. It proceeds to step ST29 when judging yes, while stands by when judging no.

At step ST29, the control device 11 performs open control of the injection speed. That is, the control device 11 refers to the OP control-use table 51, specifies the command value Cv corresponding to the present elapsed time, and outputs the control command CS of that command value Cv to the flow control valve 29. From another viewpoint, the control device 11 starts driving the flow control valve 29 to the opening direction. Note that, the point $tt_0$ in the OP control-use table 51 (target position table Tb2) is made for example the point of time at which the routine has passed step ST28.

At step ST30, the control device 11 judges whether the ending conditions of the open control are satisfied. For example, the control device 11 judges whether the output of the control command CS is completed up to the last point of time prescribed in the OP control-use table 51. Further, the control device 11 proceeds to step ST31 when judging yes while returns to step ST29 and continues the open control when judging no.

At step ST31, the control device 11 calculates the difference dD between the current detection position of the plunger 5 and the current target position of the plunger 5. That is, the control device 11, as explained with reference to FIG. 11, calculates the difference dD at the point of the end of the open control. Next, the control device 11 judges whether the difference dD (absolute value thereof) is within the predetermined permissible range (threshold value or less). Further, the control device 11 proceeds to step ST32 when judging yes while proceeds to step ST33 when judging no.

At step ST32, as explained with reference to FIG. 9, the control device 11 updates the information held in the characteristic table 55 based on the command value Cv and the speed V detected by the position sensor 37 at the time when the open control (step ST29) is executed.

At step ST33, the control device 11 outputs a control command so as to make the display device 35 display the predetermined alert image.

At step ST34, the control device 11 performs feedback control of the flow control valve 29. That is, the control device 11 specifies the target position corresponding to the present elapsed time with reference to the FB control-use table 53 and outputs the control command CS in accordance with the deviation between that specified target position and the position detected by the position sensor 37.

Note that, the flow charts in FIG. 13 to FIG. 15 are just ones for explaining the concepts of the procedures and may be suitably changed. Further, in actuality, parallel processing may be carried out as well. For example, the processing at steps ST31 to ST33 may be executed in parallel to the open control or feedback control or may be carried out after the end of the feedback control based on the detection position acquired at the time of end of the open control. Further, for example, the command value (step ST24) only have to be set before the head pressure exceeds the set value $P_S$ (before the start of open control), therefore it is also possible to make the ACC pressure acquisition condition (step ST21) the same as the injection start condition (step ST26) or make the former condition that the control command for opening the in-side valve 28 is output (step ST27).

In FIG. 13 to FIG. 15, step ST2 corresponds to the updating-use control part 67 and information updating part 69. Step ST32 also corresponds to the information updating part 69. Step ST11 corresponds to the target speed setting part 61. Steps ST12 to ST14 correspond to the target position calculation part 65. Step ST23 corresponds to the correction part 62. Steps ST12, ST13, and ST24 correspond to the command value setting part 63. Step ST29 corresponds to the OP control part 49. Step ST31 corresponds to the quality judgment part 70. Step ST33 corresponds to the display control part 71. Step ST34 corresponds to the FB control part 39.

As described above, in the present embodiment, the injection apparatus 1 has the injection cylinder 7, accumulator 23 (liquid pressure source), head-use pressure sensor 36, flow control valve 29, and control device 11. The injection cylinder 7 has the piston rod 17 which can be connected to the plunger 5 slidable in the sleeve 3 communicated with the interior of the die 101, the piston 15 fixed to the piston rod 17, and the cylinder part 13 which accommodates the piston 15 so that it can slide. The internal portion of the cylinder part 13 is partitioned by the piston 15 into the rod-side chamber 13*r* on the side of the piston rod 17 and the head-side chamber 13*h* on the opposite side. The accumulator 23 can supply hydraulic fluid to the head-side chamber 13*h*. The head-use pressure sensor 36 can detect the pressure of the head-side chamber 13*h*. The flow control valve 29 can control the flow rate of the hydraulic fluid discharged from the rod-side chamber 13*r*. The control device 11 includes the OP control part 49 which starts the open control driving the flow control valve 29 to the opening direction conditional on the detection pressure of the head-use pressure sensor 36 rising up to the predetermined set value $P_S$ after the start of the supply of the hydraulic fluid from the accumulator 23 to the head-side chamber 13*h*.

Here, as explained with reference to FIG. 10, the pressure of the head-side chamber 13*h* does not rise up to the ACC pressure simultaneously with the opening of the in-side valve 28, but gradually rises after the in-side valve 28 is opened. Accordingly, for example, when the control for opening the in-side valve 28 and the open control for opening the flow control valve 29 are simultaneously started, irrespective of the open control of the flow control valve 29 being started, the plunger 5 is liable not to move forward at the speed in accordance with the degree of opening of the flow control valve 29. As a result, for example, the precision of the speed control at the time of start of injection falls. However, in the present embodiment, the open control for opening the flow control valve 29 is started in the state where the head pressure rises up to the set value $P_S$. Therefore, for example, an inconvenience as described above is solved. Further, for example, compared with a mode where the open control of the flow control valve 29 is started conditional on a predetermined time having passed after opening of the in-side valve 28, even if pressure fluctuation of the accumulator 23 and so on occur, the head pressure when starting the open control is stabilized. As a result, the precision of the open control of the flow control valve 29 is improved.

Further, in the present embodiment, the injection apparatus 1 further has the input device 33 accepting an operation by the user. The flow control valve 29 is an overlap type which positions the spool 45 (valve element) at a position in accordance with the command value Cv of the input control command CS and keeps the first port 47A closed as it is even if the spool 45 moves at the time when the spool 45 is located in the predetermined overlapping section OR, while begins opening the first port 47A by the spool 45 having passed through the overlapping section OR. The control device 11 further has the storage part 11*a* which holds the characteristic table 55 (characteristic information) linking the command value Cv of the control command CS to the flow control valve 29 and the speed of the plunger 5 including also the movement of the plunger 5 occurring due to a clearance flow even if the spool 45 is located in the overlapping section OR; the target speed setting part 61 which sets the target speed of the plunger 5 based on an operation with respect to the input device 33; and the command value setting part 63 which sets the command value Cv of the control command CS output by the OP control part 49 by specifying the command value Cv of the control command CS to the flow control valve 29 which corresponds to the target speed set by the target speed setting part 61 based on the characteristic table 55.

Accordingly, in contrast to the conventional apparatus in which the flow control valve 29 was opened so that the spool 45 passes through the overlapping section OR in a relatively short predetermined period irrespective of setting of the target speed, in the present embodiment, in accordance with the setting of the target speed, the flow control valve 29 is suitably opened including also the state where the spool 45 is located in the overlapping section OR. As a result, for example, the trackability of the actual injection speed with respect to the target speed is improved. Further, the open control is started after the head pressure rises up to the set value $P_S$ as described above, therefore also the trackability is improved. Further, from another viewpoint, for example, compared with a mode where the open control is started without waiting for the rise of the head pressure, the head pressure when the characteristic table 55 is obtained and the head pressure at the time of start of open control approach each other, therefore the precision of the open control based on the characteristic table 55 is improved.

Further, in the present embodiment, the injection apparatus 1 has the accumulator 23 as the liquid pressure source and the ACC-use pressure sensor 34 for detecting the pressure of the accumulator 23. The control device 11 further has the correction part 62 which changes the command value Cv of the control command CS output by the OP control part 49 between cycles so that the degree of opening of the flow control valve 29 in the open control becomes larger as the detection pressure of the ACC-use pressure sensor 34 at the predetermined point of time before the start of the open control (the point of time when the positive judgment is carried out at step ST21) is lower.

Accordingly, for example, the influence of the fluctuation of the ACC pressure exerted upon the speed of the plunger 5 in the open control is reduced. Further, from another viewpoint, for example, even when the ACC pressure immediately before the start of injection is different from the ACC pressure at the time when the characteristic table 55 is obtained, the precision of the open control based on the characteristic table 55 can be improved.

Further, in the present embodiment, the correction part 62 corrects the characteristic table 55 referred to by the command value setting part 63 so that the speed of the plunger 5 linked with the command value Cv of the control command CS becomes lower as the detection pressure of the ACC-use pressure sensor 34 at the predetermined point of time before the start of the open control is lower, thereby changing the command value Cv of the control command CS output by the OP control part 49 between cycles.

Accordingly, for example, by the simple and convenient correction of multiplying the root value $\sqrt{(P2/P1)}$ of the ratio between the reference pressure P1 (for example ACC pressure when the characteristic table 55 is obtained) and the ACC pressure P2 immediately before injection with respect to the speed V held in the characteristic table 55, the command value Cv can be corrected with a high precision. For example, in a mode where a reciprocal $\sqrt{(P1/P2)}$ of the root value is multiplied with respect to the command value Cv held in the characteristic table 55 to correct the characteristic table 55 or the reciprocal $\sqrt{(P1/P2)}$ of the root value described before is multiplied with respect to the command value Cv of the control command CS set by the command value setting part 63 (such modes are also included in the art according to the present disclosure), if trying to high precisely cope with the change of the characteristics before and after the spool 45 passes through the overlapping section OR, the computation must be carried out separately before and after passing through the overlapping section OR. In the present embodiment, for example, such an inconvenience does not occur.

Further, in the present embodiment, the injection apparatus 1 further has the position sensor 37 capable of detecting the position of the plunger 5. The control device 11 further has the information updating part 69 which updates the characteristic table 55 based on the command value Cv of the control command CS output in the open control and the speed V detected by the position sensor 37 in the open control.

Accordingly, for example, the characteristic table 55 can be updated by quickly coping with the change along with time of the flow control valve 29. Further, for example, the characteristic table 55 can also be updated by dealing with the influence of the change of state from the start of operation of the die-cast machine DC1 (for example temperature rise of the hydraulic fluid) exerted upon the speed of the plunger 5. As a result, for example, the precision of the open control is suitably maintained.

Further, in the present embodiment, the control device 11 further has the quality judgment part 70 which judges whether the difference dD between the position of the plunger 5 calculated based on the target speed set by the target speed setting part 61 and the position of the plunger 5 detected by the position sensor 37 at the point of the end of the open control is within the predetermined permissible range. The information updating part 69 updates the characteristic information based on the command value Cv and the speed V in the open control (step ST32) only at the time of judgment by the quality judgment part 70 that the difference is in the permissible range (only at the time when judging yes at step ST31).

Accordingly, for example, the chance of the characteristic table 55 being ending up being updated even in a case where the speed V of the plunger 5 is an abnormal value compared with the command value Cv for some reason is reduced. As a result, for example, the reliability of the characteristic table 55 is maintained and consequently the precision of the open control is maintained. Further, the quality is judged based on the calculated position (target position) and the detected position at the time of end of open control, therefore the quality is judged based on the result at the point of time when the probability of the largest error is high, therefore the reliability of the judgment result is high although the comparison is carried out only at one point of time.

Further, in the present embodiment, the control device 11 further has the FB control part 39 for performing feedback control of the flow control valve 29 continuing from the open control so that the target speed set by the target speed setting part 61 is realized based on the detected value of the position sensor 37.

Accordingly, for example, at the time of start of injection, a higher precision of the injection speed is achieved by the open control. After that, a higher precision of the injection speed is achieved by the feedback control. As a result, for example, it is not necessary to make the feedback control possible at the time of start of injection when the injection speed is relatively low and the spool 45 is positioned in the overlapping section OR. Consequently, it is not necessary to use the position sensor 37 having a high resolution or adjust the gain.

Further, in the present embodiment, the characteristic information linking the command value Cv of the control command CS to the flow control valve 29 and the speed V of the plunger 5 is the table (characteristic table 55) linking the predetermined plurality of command values Cv and the plurality of speeds V of the plunger 5. The control device 11 further has the updating-use control part 67 which sequentially outputs control commands of the predetermined plurality of command values Cv separately from the molding cycle. The information updating part 69 updates the speeds V linked with the predetermined plurality of command values Cv in the characteristic table 55 according to the speeds V detected by the position sensor 37 at the times when the control commands CS of the predetermined plurality of command values Cv described before are sequentially output from the updating-use control part 67.

Accordingly, for example, the command values Cv held in the characteristic table 55 and the command values Cv in the measurement for generating the characteristic table 55 correspond to each other, therefore the speed corresponding to the command value Cv can be correctly acquired. Consequently, the reliability of the characteristic table 55 is improved, and it becomes easier for the speed of the plunger 5 to track the target speed.

Further, in the present embodiment, the control device 11 has the target position calculation part 65 which calculates the target position of the plunger 5 for each elapse of time based on the target speed set by the target speed setting part 61. The FB control part 39 calculates the command value Cv for each elapse of time based on the sum of the value proportional to the deviation De between the position Dd of the plunger 5 detected by the position sensor 37 at that time and the target position Dt of the plunger 5 at that time and the predetermined offset value. Further, the FB control part 39 uses the last command value ($Ct_n$ in FIG. 7) in the open control as the offset value.

Accordingly, it becomes easier to suppress steady-state deviation. Further, also continuity of the speed of the plunger 5 when shifting from the open control to the feedback control is secured. As a result, the trackability of the speed of the plunger 5 with respect to the target speed is more improved.

Further, in the present embodiment, the control device 11 has the display control part 71 which makes the display device 35 display a predetermined alert image at the time when the deviation dD (FIG. 9) between the position of the plunger 5 at the time of end of the open control calculated based on the target speed set by the target speed setting part 61 and the position of the plunger 5 detected by the position sensor 37 at the time of end of the open control exceeds the predetermined threshold value.

Accordingly, the operator can learn the timing at which the characteristic table 55 must be updated and so on. As a result, for example, the change along with time etc. of the flow control valve 29 can be coped with at an early stage before a large amount of defective products are produced.

Further, in the present embodiment, the OP control part 49 and FB control part 39 control the flow control valve 29 so as to switch from the open control to the feedback control at the time when a constant speed is reached in the case where the target speed of the plunger 5 set by the target speed setting part 61 rises to the constant speed (low injection speed $V_L$) from the start of injection and then that constant speed is maintained.

Usually, such a first constant speed (low injection speed $V_L$) after the start of injection is a relatively low speed and is sufficiently high compared with the speed of the plunger 5 when the spool 45 passes through the overlapping section OR ($V_{OL}$ in FIG. 5). Accordingly, by switching from the open control to the feedback control at the time when such a speed (low injection speed $V_L$) is reached, for example, the inconvenience that the feedback control is executed in the overlapping section OR or the open control is unnecessarily executed for a long time hardly ever occurs. That is, as a whole, the speed control is suitably carried out.

In the above embodiment, the die-cast machine DC1 is one example of the molding machine. The accumulator 23 is one example of the liquid pressure source. The OP control part 49 is one example of the open control part. The spool 45 is one example of the valve element. The first port 47A is one example of the port. The characteristic table 55 is one example of the characteristic information. The ACC-use pressure sensor 34 is one example of the accumulator-use pressure sensor. The FB control part 39 is one example of the feedback control part.

The technique according to the present disclosure is not limited to the above embodiment and may be executed in various ways.

The molding machine is not limited to a die-cast machine. For example, the molding machine may be another metal molding machine or may be an injection molding machine for molding a resin or may be a molding machine for molding a material obtained by mixing a thermoplastic resin or the like with sawdust. Further, the injection apparatus is not limited to a horizontal clamping/horizontal injection type and may be for example a vertical clamping/vertical injection type, horizontal clamping/vertical injection type, or vertical clamping/horizontal injection type.

The configurations for realizing various functions such as the function of updating the characteristic information, the function of making the last command value of the open control the offset value, the function of judging the quality of the control result, and/or the function of displaying an alert need not be provided. Even if such functions are not provided, the control of the flow control valve considering the rise of the head pressure is still carried out.

The liquid pressure source for supplying the hydraulic fluid to the head-side chamber at the time of start of injection is not limited to the accumulator. For example, it may be a pump or a cylinder where the piston is driven by an electric motor. Further, a liquid pressure source other than the accumulator may be utilized throughout the entire injection or may be utilized only in the initial stage of injection. Even in such a mode, for example, by the open control of the flow control valve being started after the head pressure rises up to the set value, the plunger can be quickly driven from the start of driving of the flow control valve to the opening direction. From another viewpoint, the precision of the open control at the time of start of injection can be improved.

In the embodiment, the supply of the hydraulic fluid from the liquid pressure source to the head-side chamber was started by opening the in-side valve. However, as described above, the liquid pressure source is not limited to an accumulator. Therefore, for example, the supply of the hydraulic fluid to the head-side chamber may be started by the start of driving of the pump or the electric motor driving the cylinder as well. The control device may judge whether the head pressure rises to the set value after outputting the control command for starting the supply of the hydraulic fluid.

The open control is not limited to control of outputting the control command of the command value in accordance with the target speed set by an operation by the operator. For example, irrespective of the target speed set by the operator explained with reference to FIG. 6A and FIG. 6B, the open control may be control for opening the flow control valve up to the constant degree of opening for a constant period as well. Even in this case, by starting the open control of the flow control valve after the head pressure rises up to the set value, for example, the plunger can be quickly driven from the start of the open control.

The flow control valve is not limited to the overlap type. From another viewpoint, the overlap characteristic need not be added to the method of setting the command value and/or characteristic information either. Further, even if the flow control valve is the overlap type, the overlap characteristic need not be added to the method of setting the command value and/or characteristic information either. Further, the flow control valve of the overlap type is not limited to a spool type. For example, it may be a sliding valve in which the valve element rotates around the axis as well.

The characteristic information linking the command value of the control command to the flow control valve and the speed of the plunger is not limited to a table linking a plurality of command values and a plurality of speeds. For example, the characteristic information may be a formula for calculating the command value from the speed as well. Further, the characteristic information need not be information directly linking the command value and the speed and may be comprised of for example information linking the command value and the flow rate in the flow control valve and information linking the flow rate and the speed of the plunger.

In the embodiment, the judgment of whether the characteristic information should be updated (step ST32) based on the command value in the open control and the detected speed and the judgment of whether an alert should be displayed (step ST33) were regarded as the same judgment (step ST31). However, the two judgments may also be based on indicators (difference dD in the embodiment) which are different from each other or even if the indicators are the same, the threshold values may be different between the two.

The explanation of the embodiment alluded to the fact that it is not necessary to update the characteristic information based on the command value in the open control and the detected speed for each cycle. In the same way, it is not necessary to change the command value based on the ACC pressure between cycles (to correct the characteristic information) for each cycle. For example, it may be changed after each of a predetermined number of cycles or may be changed at the time when the rate of change of the ACC pressure with respect to the reference pressure (for example the ACC pressure when the characteristic information is obtained) exceeds a predetermined range.

The change of the command value based on the ACC pressure between the cycles is not limited to the correction of the value of the speed in the characteristic table referred to also in the embodiment. For example, when specifying the command value corresponding to the target speed based on the characteristic information, the reciprocal of the root value of the ratio of the ACC pressure may be multiplied with the target speed to calculate the speed for specifying the command value, and the command value corresponding to the speed for specifying the command value may be obtained based on the characteristic information.

In the embodiment, the injection speed was set with respect to the position of the plunger through the input device. However, the injection speed may be set with respect to the elapsed time through the input device as well. Further, in the embodiment, the speed feedback control was substantially carried out by directly performing position feedback control. However, speed feedback control based on the deviation of the speed itself may be carried out as well.

In the embodiment, the position (point of time) at which the injection speed reaches the first constant speed (low injection speed) was made the switching position at which the open control was switched to feedback control. However, the switching position may be made another position as well.

Further, the switching position may be made for example the position at which the valve element passes through the overlapping section and moves a predetermined amount away from the overlapping section. That is, without setting the switching position based on the set target speed, the switching position may be set based on the flow rate characteristic of the valve element as well. Note that, in the embodiment, by referring to the target position Dt held in the target position table Tb2, the data corresponding to the range from the start of injection to the switching position was extracted from the target position table Tb2. As described above, in the case where the switching position is set using the overlapping section as a reference, for example, except for the extraction of the data from the target position table Tb2, in the same way as the embodiment, a table linking the elapsed time and the command value may be prepared, then, by extraction of the range until the command value reaches the value set in advance (value corresponding to the end of the open control), the OP control-use table 51 may be generated. Further, based on the elapsed time at the time when the command value reaches the value set in advance in the OP control-use table 51, the FB control-use table 53 may be extracted from the target position table Tb2.

The judgment of the quality of the control result is not limited to one based on the position at the point of time of the end of the open control. For example, error from the start of injection up to the end of the open control may be continuously acquired and the judgment may be carried out by using the maximum value among them.

In the embodiment, after the supply of the hydraulic fluid to the head-side chamber 13*h* was started, the open control of the flow control valve 29 was started at the time when the detection pressure of the head-use pressure sensor 36 rose up to the set value. Here, in a situation where the flow control valve is closed, along with the rise of the head pressure, the rod pressure also rises. Accordingly, after the supply of the hydraulic fluid to the head-side chamber 13*h* is started, the open control of the flow control valve 29 may be started at the time when the detection pressure of the rod-use pressure sensor 38 rises up to the set value.

Various characteristic features shown in the embodiment except the characteristic feature that the open control of the flow control valve of the meter-out circuit is started when the head pressure rises up to the set value may be applied to an injection apparatus and molding machine not predicated on the flow control valve of the meter-out circuit or open control of the flow control valve or the like. For example, characteristic features such as the setting of the command value based on the characteristic information considering the overlap characteristic, updating of the characteristic information, and correction of the characteristic information based on the ACC pressure may be applied to the open control of the flow control valve configuring the meter-in circuit.

REFERENCE SIGNS LIST

1 . . . injection apparatus, 3 . . . sleeve, 5 . . . plunger, 7 . . . injection cylinder, 11 . . . control device, 13 . . . cylinder part, 13*r* . . . rod-side chamber, 13*h* . . . head-side chamber, 15 . . . piston, 17 . . . piston rod, 23 . . . accumulator (liquid pressure source), 29 . . . flow control valve, 36 . . . head-use pressure sensor, and 49 . . . OP control part (open control part).

The invention claimed is:

1. An injection apparatus comprising an injection cylinder which includes:

a piston rod connectable to a plunger capable of sliding in a sleeve communicated with an interior of a die, a piston fixed to the piston rod, and a cylinder part slidably accommodating the piston, in which an internal portion of the cylinder part is partitioned by the piston into a rod-side chamber on a piston rod side and a head-side chamber on an opposite side;

an input device configured to accept an operation by a user;

a liquid pressure source which is configured to supply a hydraulic fluid to the head-side chamber;

a head-use pressure sensor which is configured to detect a pressure of the head-side chamber;

a flow control valve which is configured to control a flow rate of the hydraulic fluid discharged from the rod-side chamber, wherein the flow control valve is configured to position a valve element at a position in accordance with a command value of an input control command, keeps a port closed while the valve element moves at a time when the valve element is located at a predetermined overlapping section at which a part of the valve element overlaps the port, and makes the port begin opening by the valve element passing through the overlapping section; and a control device which includes:

an open control part configured to start open control driving the flow control valve to an opening direction after a start of supply of the hydraulic fluid from the liquid pressure source to the head-side chamber conditional on a detection pressure of the head-use pressure sensor rising up to a predetermined set value, a storage part configured to hold characteristic information linking a command value of the input control command to the flow control valve and a speed of the plunger including movement of the plunger caused by clearance flow while the valve element is located in the overlapping section, a target speed setting part configured to set a target speed of the plunger based on an operation accepted by the input device, and a command value setting part configured to set a command value of a control command output by the open control part in the open control by specifying the command value of the input control command to the flow control valve corresponding to the target speed set by the target speed setting part based on the characteristic information.

2. The injection apparatus according to claim 1, further comprising:

an accumulator as the liquid pressure source; and an accumulator-use pressure sensor configured to detect the pressure of the accumulator, wherein:

the control device further comprises a correction part configured to make the command value of the control command output by the open control part change between cycles so that an opening of the flow control valve in the open control becomes larger as the detection pressure of the accumulator-use pressure sensor at a predetermined point of time before a start of the open control is lower.

3. The injection apparatus according to claim 2, wherein the correction part is configured to make the command value of the control command output by the open control part change between cycles by correcting the characteristic information referred to by the command value setting part so that the speed of the plunger linked with the command value of the control command becomes lower as the detection pressure of the accumulator-use pressure sensor at the predetermined point of time is lower.

4. The injection apparatus according to claim 1, further comprising a position sensor capable of detecting a position of the plunger, wherein the control device further comprises an information updating part configured to update the characteristic information based on a command value of the control command output in the open control and on a speed detected by the position sensor in the open control.

5. The injection apparatus according to claim 4, wherein:

the control device further comprises a quality judgment part configured to judge whether a difference between the position of the plunger calculated based on the target speed set by the target speed setting part and the position of the plunger detected by the position sensor at a point of an end of the open control is within a predetermined permissible range, and the information updating part is configured to update the characteristic information based on the command value and speed in the open control only during a time of judgment by the quality judgment part that a difference is in a permissible range.

6. The injection apparatus according to claim 1, further comprising:

a position sensor configured to detect a position of the plunger, and a display device configured to display an image, wherein the control device further comprises:

a quality judgment part configured to judge whether a difference between a position of the plunger calculated based on the target speed set by the target speed setting part and the position of the plunger detected by the position sensor at a point of an end of the open control exceeds a predetermined threshold value and a display control part configured to make the display device display a predetermined alert image in response to judging that the difference exceeds the threshold value.

7. The injection apparatus according to claim 1, further comprising a position sensor capable of detecting a position of the plunger, wherein the control device further comprises a feedback control part configured to perform, continuing from the open control, feedback control of the flow control valve based on a detection value of the position sensor so that the target speed set by the target speed setting part is realized.

8. A molding machine comprising the injection apparatus according to claim 1.

9. An injection apparatus comprising an injection cylinder which includes:

a piston rod connectable to a plunger capable of sliding in a sleeve communicated with an interior of a die, a piston fixed to the piston rod, and a cylinder part slidably accommodating the piston, in which an internal portion of the cylinder part is partitioned by a piston to a rod-side chamber on a piston rod side and a head-side chamber on an opposite side;

an input device configured to accept an operation by a user;

a liquid pressure source which is configured to supply a hydraulic fluid to the head-side chamber;

a rod-use pressure sensor which is configured to detect a pressure of the rod-side chamber;

a flow control valve which is configured to control a flow rate of the hydraulic fluid discharged from the rod-side chamber, wherein the flow control valve is configured to position a valve element at a position in accordance with a command value of an input control command, keep a port closed while the valve element moves at a time when the valve element is located at a predetermined overlapping section at which a part of the valve element overlaps the port, and make the port begin opening by the valve element passing through the overlapping section; and a control device which includes:

an open control part configured to start open control driving the flow control valve to an opening direction after a start of supply of the hydraulic fluid from the liquid pressure source to the head-side chamber conditional on a detection pressure of the rod-use pressure sensor rising up to a predetermined set value, a storage part configured to hold characteristic information linking a command value of the input control command to the flow control valve and a speed of the plunger including movement of the plunger caused by clearance flow while the valve element is located in the overlapping section, a target speed setting part configured to set a target speed of the plunger based on an operation accepted by the input device, and a command value setting part configured to set a command value of a control command output by the open control part in the open control by specifying the command value of the input control command to the flow control valve corresponding to the target speed set by the target speed setting part based on the characteristic information.

* * * * *